US006910760B2

(12) United States Patent
Kubota et al.

(10) Patent No.: US 6,910,760 B2
(45) Date of Patent: Jun. 28, 2005

(54) LIQUID DISCHARGE HEAD AND METHOD FOR MANUFACTURING RECORDING HEAD

(75) Inventors: Masahiko Kubota, Tokyo (JP); Wataru Hiyama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/614,029

(22) Filed: Jul. 8, 2003

(65) Prior Publication Data

US 2004/0008240 A1 Jan. 15, 2004

(30) Foreign Application Priority Data

Jul. 10, 2002 (JP) ..... 2002-201875

(51) Int. Cl.[7] ..... B41J 2/05
(52) U.S. Cl. ..... 347/56; 347/61
(58) Field of Search ..... 347/20, 54–56, 347/61, 63–65, 40–43

(56) References Cited

U.S. PATENT DOCUMENTS

| | | | | |
|---|---|---|---|---|
| 4,611,219 A | * | 9/1986 | Sugitani et al. | 347/40 |
| 4,882,595 A | | 11/1989 | Trueba et al. | |
| 5,218,376 A | | 6/1993 | Asai | |
| 6,155,673 A | | 12/2000 | Nakajima et al. | |
| 6,158,843 A | | 12/2000 | Murthy et al. | |
| 6,305,774 B1 | * | 10/2001 | Torgerson et al. | 347/12 |
| 6,426,481 B1 | | 7/2002 | Koide et al. | |
| 6,472,125 B1 | | 10/2002 | Koide et al. | |
| 2003/0011655 | | 1/2003 | Miyagawa et al. | |
| 2003/0016270 | | 1/2003 | Kubota et al. | |
| 2003/0030702 | | 2/2003 | Komuro et al. | |

FOREIGN PATENT DOCUMENTS

| | | |
|---|---|---|
| JP | 54-161935 | 12/1979 |
| JP | 61-185455 | 8/1986 |
| JP | 61-249768 | 11/1986 |
| JP | 4-10940 | 1/1992 |
| JP | 4-10941 | 1/1992 |

* cited by examiner

*Primary Examiner*—Stephen D. Meier
*Assistant Examiner*—An H. Do
(74) *Attorney, Agent, or Firm*—Fitzpatrick, Cella, Harper & Scinto

(57) ABSTRACT

A liquid discharge head includes a first bubbling chamber, a second bubbling chamber arranged thereon, and a discharge port portion communicated with the second bubbling chamber with a difference in level. The sidewalls of the second bubbling chamber contract in the direction toward the discharge port at an inclination of 10 to 45°. On the circumferential portion of the upper face of the first bubbling chamber in contact with an opening communicated with the second bubbling chamber, an extrusion is formed continuously to surround the opening, in the direction toward the main surface of the element base plate.

11 Claims, 14 Drawing Sheets

LIQUID DISCHARGE HEAD AND METHOD FOR MANUFACTURING RECORDING HEAD

BACKGROUND OF THE INVENTION

1. Field of the Invention

The present invention relates to a liquid discharge head for recording on a recording medium by discharging liquid droplets, such as ink droplets. The invention also relates to the method of manufacture therefor. More particularly, the invention relates to a liquid discharge head that performs ink jet recording.

2. Related Background Art

The ink jet recording method is one of the so-called non-impact recording methods. The ink jet recording method is capable of performing high-speed recording, and the noises, which are generated at the time of recording, are as small as almost negligible. Also, the ink jet recording method makes it possible to record on various kinds of recording medium, and fix ink on a plain sheet without any particular treatment given thereto. Further, with this method, highly precise images can be obtained at lower costs. With these advantages, the ink jet recording method has been used not only as a printer serving as a peripheral device of a computer, but also, in recent years, it has been used rapidly and widely as recording means for a copying machine, facsimile equipment, a work processor, and the like.

As the ink discharge methods generally utilized for ink jet recording, there are the one that adopts electrothermal converting element, such as heater, as element for generating discharge energy used for discharging ink droplets, and the one that uses piezoelectric element, such as piezo-element. With either method, it is possible to control the discharge of ink droplets using electric signals. The principle of the ink discharge method that uses electrothermal converting element is that by the application of voltage to the electrothermal converting element, ink in the vicinity of the electrothermal converting element is boiled instantaneously to discharge ink at high speed by the abrupt development of bubble generated by the phase change of ink taking place as it is boiled. On the other hand, the principle of the ink discharge method that uses piezoelectric element is that by the application of voltage to the piezoelectric element, the piezoelectric element is displaced to discharge ink droplets by the pressure exerted when such displacement takes place.

Then, for the ink discharge method using the electrothermal converting element, there is no need for securing a large space for the arrangement of the discharge energy-generating element. Therefore, it has such advantages as to make the structure of the liquid discharge head simpler, and also, to make it easier to effectuate a higher integration of nozzles, among some others. On the other hand, this ink discharge method characteristically has weakness in that the heat and others, which are generated by the electrothermal converting element, are accumulated in the liquid discharge head to cause the volumes of flying ink droplets to vary; the cavitation resulting from bubble extinction may produce unfavorable effect on the electrothermal converting element; and the air dissolved into ink may become remaining bubbles in the liquid discharge head. Such weakness may exert unfavorable influence on the discharge characteristics of ink droplets or the quality of recorded images in some cases.

In order to solve these problems, there have been proposed the ink jet recording methods and ink discharge heads in the specifications of Japanese Patent Application Laid-Open No. 54-161935, Japanese Patent Application Laid-Open No. 61-185455, Japanese Patent Application Laid-Open No. 61-249768, and Japanese Patent Application Laid-Open No. 04-10941. In other words, the ink jet recording methods disclosed in the aforesaid specifications are structured so that bubbles generated by driving the electrothermal converting element by means of electric signals are communicated with the air outside. With the adoption of such ink jet recording method, it is attempted to stabilize the volumes of flying ink droplets. Thus, droplets each having extremely small amount of ink can be discharged at high speed, and the enhancement of durability of heater is attempted by eliminating the cavitation generated at the time of bubble extinction, among some other improvements that have been made possible. As a result, it becomes easier to obtain highly precise images in a better condition. In accordance with the specifications of the aforesaid Japanese Patent Applications, the structure arranged to enable bubbles to be communicated with the air outside is such that the shortest distance between the electrothermal converting element and discharge port is made significantly smaller than the conventional art.

Now, the description will be made of the conventional liquid discharge head of the kind. The conventional liquid discharge head is provided with an element base plate having the electrothermal converting element for discharging ink, and the orifice base plate bonded to the element base plate so as to form ink flow path. The orifice base plate is provided with plural discharge ports for discharging ink droplets; plural nozzles that enable ink to flow; and the ink supply chamber to supply ink to each of these nozzles. The nozzle is structured with the bubbling chamber where bubble is generated in ink retained therein by means of the electrothermal converting element, and the supply path for supplying ink to this bubbling chamber. For the element base plate, it is arranged to position the electrothermal converting element in the bubbling chamber. Also, there is arranged for the element base plate the supply port for supplying ink to the supply chamber from the backside of the main face adjacent to the orifice base plate. Then, for the orifice base plate, the discharge port is arranged in the position facing the electrothermal converting element on the element base plate.

For the conventional liquid discharge head structured as described above, ink is supplied from the supply port into the supply chamber along each of the nozzles, and filled in the bubbling chamber. Ink filled in the bubbling chamber is caused to fly in the direction almost orthogonal to the main surface of the element base plate by means of the bubble, which is generated when ink is given film boiling by the electrothermal converting element. Thus, ink is discharged from the discharge port as ink droplet.

Then, higher speed recording should be considered for the recording apparatus provided with the aforesaid liquid discharge head in order to attempt the higher quality output of images, the higher quality of recorded images, the output of higher resolution, and the like. To attain the high-speed recording, it has been attempted to increase the discharge frequency of ink droplets to fly from each of the nozzles of the liquid discharge head, that is, to increase the frequency of discharges, such as disclosed in the specifications of U.S. Pat. Nos. 4,882,595, and 6,158,843.

Particularly, in the specification of U.S. Pat. No. 6,158,843, the structure is proposed for the improvement of ink flow from the supply port to the supply path with the arrangement of the space that enables the ink flow path to be narrowed locally or with the arrangement of extruded-fluid resistive element in the vicinity of the supply port.

Nevertheless, in the conventional liquid discharge head described above, part of ink filled in the bubbling chamber is pushed back unavoidably to the supply path when ink droplet is discharged by the developed bubble in the bubbling chamber. As a result, the conventional liquid discharge head is encountered with the drawback that the discharge amount of ink droplet tends to be reduced along with the reduction of the volume of ink in the bubbling chamber.

Also, in the conventional liquid discharge head, part of pressure exerted on the developing bubble on the supply path side is allowed to escape to the supply path side or pressure loss takes place due to friction between the bubble and the inner walls of the bubbling chamber when part of ink filled in the bubbling chamber is pushed back to the supply path. As a result, the conventional liquid discharge head is encountered with a problem that the discharge speed of ink droplet is reduced along the reduction of bubble pressure.

Also, for the conventional liquid discharge head, there is a problem that the volume of small amount of ink filled in the bubbling chamber is caused to vary due to the bubble that is developed in the bubbling chamber, and therefore, the discharge amount of ink droplet is caused to vary accordingly.

SUMMARY OF THE INVENTION

Here, the present invention is designed to attempt higher discharge speed of liquid droplets, as well as to stabilize the discharge amount thereof. It is an object of the invention to provide a liquid discharge head for which the discharge efficiency of liquid droplets are enhanced, and also, to provide the method of manufacture therefor.

In order to achieve the aforesaid object, the liquid discharge head of the present invention comprises a discharge energy generating element for generating energy for discharging a liquid droplet; an element base plate provided with the discharge energy generating element on the main surface thereof; and an orifice base plate bonded to the main surface of the element base plate, being provided with a nozzle having a discharge port portion with a discharge port for discharging a liquid droplet, a bubbling chamber for generating bubble in liquid therein by the discharge energy generating element, and a supply path for supplying liquid to the bubbling chamber, and a supply chamber for supplying liquid to the nozzle. For this liquid discharge head, the bubbling chamber is formed by a first bubbling chamber communicated with the supply path with the main surface of the element base plate as the bottom face thereof for generating bubble in liquid therein by the discharge energy generating element, and also, a second bubbling chamber communicated with the first bubbling chamber, and the central axis of the lower face of the second bubbling chamber and the central axis of the upper face of the second bubbling chamber are in agreement in the direction perpendicular to the base plate, and the sectional area of the upper face with respect to the central axis of the second bubbling chamber is smaller than the sectional area of the lower face with respect to the central axis of the second bubbling chamber, and the sectional area in the direction toward the central axis is continuously changed from the lower face to the upper face of the second bubbling chamber, and on the circumferential portion of the upper face of the first bubbling chamber in parallel with the main surface of the element base plate, and in contact with the opening communicated with the second bubbling chamber, an extrusion is formed continuously to surround the opening in the direction toward the main face of the element base plate.

Also, for the liquid discharge head thus structured, the height, the width, or the sectional area of flow path in the nozzle is changed, and the structure is arranged so that the volume of ink is gradually reduced in the direction from the base plate to the discharge port. Then, the structure is arranged to provide such a configuration that in the vicinity of the discharge port, when liquid droplet flies, the flying liquid droplet flies vertically to the base plate, and also, to provide the function to straighten (rectify) the liquid flow. Also, when liquid is discharged, it is made possible to suppress the event that the liquid, which is filled in the bubbling chamber, is pushed out to the supply path side by the bubble, which is generated in the bubbling chamber. As a result, in accordance with this liquid discharge head, the occurrence of variation is suppressed in the discharge volumes of liquid droplets to be discharged, and the discharge volume is secured exactly. Also, for this liquid discharge head, when liquid droplet is discharged, the bubble, which is developed in the bubbling chamber, abuts the inner walls of the control portion in the bubbling chamber, which is formed by the portion having difference in level. As a result, the loss of pressure exerted by bubble can be suppressed. Therefore, in accordance with this liquid discharge head, it becomes possible to secure the bubble developed in the bubbling chamber in good condition sufficiently, hence enhancing the discharge speed of liquid droplet.

BRIEF DESCRIPTION OF THE DRAWINGS

FIG. 8A shows an element base plate; FIG. 8B illustrates the state where a lower resin layer and an upper resin layer are formed on the element base plate; FIG. 8C, the state where a covering resin layer is formed; FIG. 8D, the state where a supply port is formed; and FIG. 8E, the state where the inner lower resin layer and upper resin layer are dissolved to flow out.

FIG. 9A shows the element base plate;

FIG. 9B illustrates the state where the lower resin layer is formed on the element base plate; FIG. 9C, where the upper resin layer is formed on the element base plate; FIG. 9D, the state where a pattering formation is given to the upper resin layer formed on the element base plate; and FIG. 9E, the state where a pattering formation is given to the upper resin layer formed on the element base plate.

FIG. 10A shows the state where a resin covering layer is formed, which serves as the orifice base plate; FIG. 10B, the state where the discharge port portion is formed; FIG. 10C, the supply port is formed; and FIG. 10D, the state where the inner lower resin layer and upper resin layer are dissolved to flow out for the completion of the liquid discharge head.

FIG. 17A shows a nozzle of the first nozzle array; FIG. 17B, a nozzle of the second nozzle array.

FIG. 18A shows the element base plate; FIG. 18B illustrates the state where the lower resin layer is formed on the element base plate; FIG. 18C, where the upper resin layer is formed on the element base plate; FIG. 18D, the state where a pattering formation is given to the upper resin layer formed on the element base plate and an inclination is formed on the side face; and FIG. 18E, the state where a pattering formation is given to the upper resin layer formed on the element base plate.

FIG. 19A shows the state where a resin covering layer is formed, which serves as the orifice base plate; FIG. 19B, the state where the discharge port portion is formed; FIG. 19C, the supply port is formed; and FIG. 19D, the state where the inner lower resin layer and upper resin layer are dissolved to flow out for the completion of the liquid discharge head.

DETAILED DESCRIPTION OF THE PREFERRED EMBODIMENTS

Hereinafter, with reference to the accompanying drawings, the description will be made of the specific embodiments of the liquid discharge head that discharges liquid droplets, such as ink, in accordance with the present invention.

At first, a liquid discharge head of the present embodiment will be described briefly. The liquid discharge head of the present embodiment is provided, in particular, with means for generating thermal energy as energy to be utilized for discharging liquid ink among those of ink jet recording methods. The liquid discharge head adopts the method whereby to generate changes in the state of ink by the application of thermal energy thus generated. By use of this method, it becomes possible to attain recording characters, images, and the like in high density and high precision. Particularly, in accordance with the present embodiment, heat-generating resistive element is used as means for generating thermal energy, and with the heat-generating resistive element, ink is heated. Then, ink is discharged by the utilization of pressure exerted by the bubble, which is generated when ink is given film boiling.

(First Embodiment)

Figure 1:
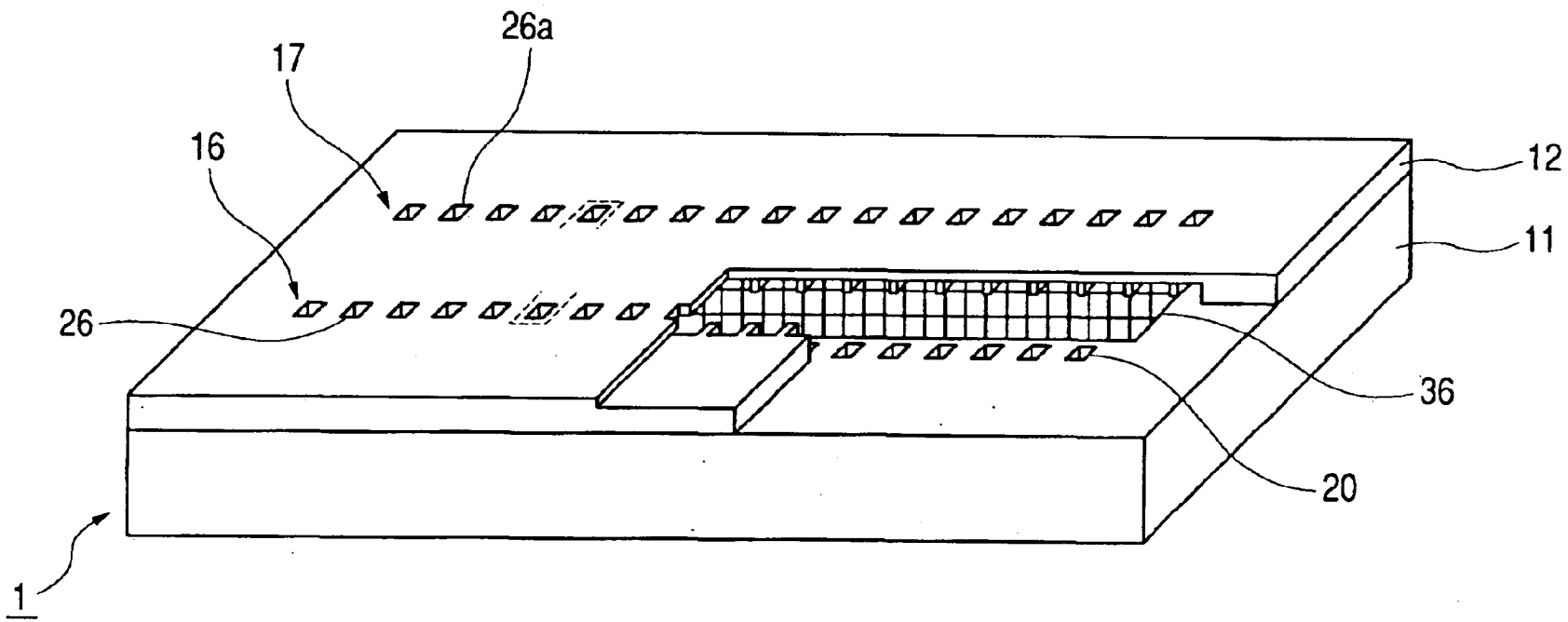
FIG. 1 is a perspective view schematically illustrates the entire structure of a liquid discharge head in accordance with the present invention.

Although details will be described later, the recording head 1 of a first embodiment is structured, as shown in FIG. 1, with the partition walls extended from the discharge port to the vicinity of supply port in order to form the nozzle that serves as the ink flow path individually for each of the plural heaters serving as heat-generating resistive element. For the liquid discharge head of the kind, the ink discharge means, to which the ink jet recording method is applicable, is provided as disclosed in the specifications of Japanese Patent Application Laid-Open Nos. 04-10940 and 04-10941. Then, the bubble, which is generated at the time of ink discharge, is communicated with the air outside through the discharge port.

Then, the liquid discharge head 1 is provided with a first nozzle array 16 in which plural heaters and plural nozzles are provided, and the longitudinal direction of each nozzle is arranged in parallel, and a second nozzle array 17 arranged in the position facing the first nozzle array with the supply chamber between them. The first and second nozzle arrays 16 and 17 are formed so that any one of adjacent nozzles has an interval of 600 dpi pitch, respectively. Also, each nozzle 17 of the second nozzle array is arranged with respect to the first nozzle array 16 so that each pitch of the adjacent nozzles is displaced by ½ pitch from each other.

Here, the description will be made briefly of the concept with which to optimize the liquid discharge head 1, which is provided with the first and second nozzle arrays 16 and 17 having plural heaters and plural nozzles arranged in high density.

Generally, as the physical quantity that may exert influence on the discharge characteristics of a liquid discharge head, inertance (inertial force) and resistance (viscosity resistance) act greatly in each nozzle of those provided in the plural number. The kinetic equation of the incompressible fluid that moves in the flow path of any configuration is expressed by the following two formulas:

$$\Delta \cdot v = 0 \text{ (continuous equation)} \quad (1)$$

$$(\partial v/\partial t) + (v \cdot \Delta)v = -\Delta(P/\rho) + (\mu/\rho)\Delta^2 v + f \text{ (navier-stokes equation)} \quad (2)$$

Given the first and second equations as those having sufficiently small terms against fluid and viscosity, and having no external force, either, and the following approximation is obtainable:

$$\Delta^2 P=0 \quad (3)$$

Then, the pressure can be expressed by use of harmonic function.

Figure 2:
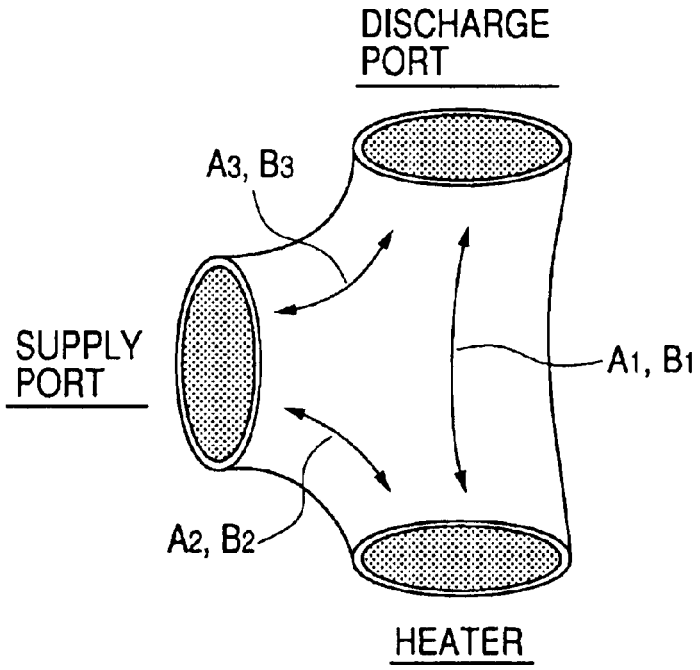
FIG. 2 is a view that schematically shows the flow of liquid of a liquid discharge head in accordance with a three-opening model.
Figure 3:
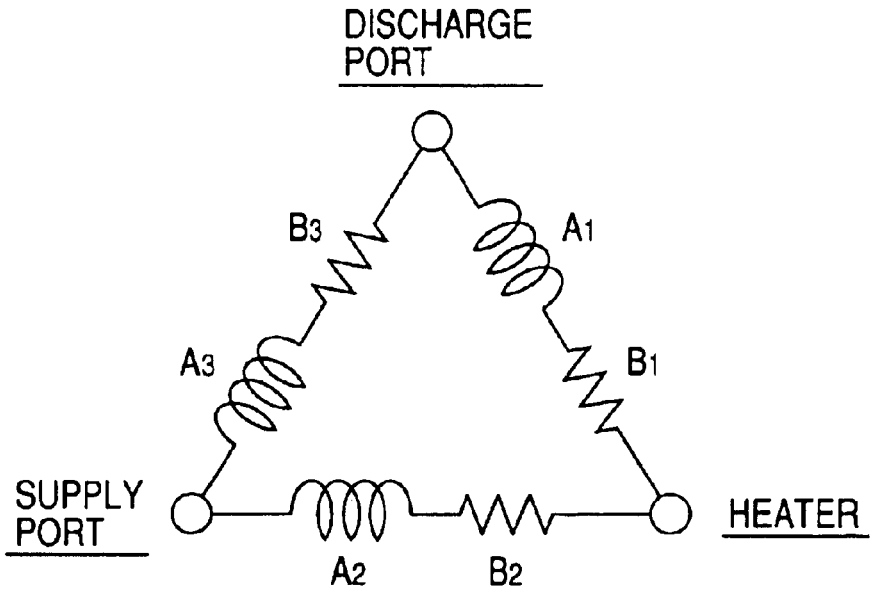
FIG. 3 is a view that schematically shows the liquid discharge head in accordance with an equivalent circuit.

In the case of the liquid discharge head, expression is possible in accordance with the three-opening model shown in FIG. 2, and the equivalent circuit shown in FIG. 3.

The inertance is defined as the "difficulty in movement" when stationary fluid starts to move abruptly. In the electrical expression, it acts similarly as the inductance that impedes the changes of current. In a case of the spring mass model, it is equivalent to the weight (mass).

If the inertance is expressed in an equation, it is represented as follows by the ratio to the time differential of second order of the volume V of fluid, that is, the time differential of the flow rate F (=ΔV/Δt), when the pressure difference is given to the opening:

$$(\Delta^2 V/\Delta t^2)=(\Delta F/\Delta t)=(1/A)\times P \quad (4)$$

where the A is inertance.

For example, on the assumption that a pseudo-duct flow path of pipe type is taken, giving the density as ρ, the length as L, and the sectional area as So, the inertance Ao of this one-dimensional pseudo-duct flow path is expressed as follows:

$$Ao=\rho\times L/So.$$

Thus, it is understandable that it is proportional to the length of the flow path, and is inversely proportional to the sectional area.

On the basis of the equivalent circuit shown in FIG. 3, it is possible to estimate and analyze the discharge characteristics of a liquid discharge head as a model.

In accordance with the liquid discharge head of the present invention, the discharge phenomenon is taken as the phenomenon in which the inertial flow is transited to the flow of viscosity. Particularly, at the early stage of bubbling generated by use of heater in the bubbling chamber, the inertial flow is main, and on the contrary, in the later period of discharge (that is, during the period in which the meniscus formed at the discharge port begins to move to the ink flow path side, and returns when ink is filled up to the opening end face of the discharge port by means of capillary phenomenon), the flow of viscosity becomes main. At this juncture, from the aforesaid relational equation, the inertance contributes greatly to the discharge characteristics, the discharge volume and discharge speed, in particular, at the early stage of bubbling owing to the quantitative relations thereof, and the amount of resistance (viscosity resistance) greatly contributes to the discharge characteristics, the time required for refilling ink (hereinafter, referred to as refilling time), in particularly, in the later period of discharge.

Here, the resistance (viscosity resistance) is described by the equation 1, and the stationary Stokes' method expressed as follows:

$$\Delta P=\eta\Delta^2\mu \quad (5)$$

Hence obtaining the viscosity resistance B. Also, in the later period of discharge, the meniscus is generated in the vicinity of the discharge port as shown by the model shown in FIG. 2, and mainly by the suction exerted by capillary force, the flow of ink takes place. Therefore, it can be approximated by use of a two-opening model (one-dimensional flow model).

In other words, it is possible to obtain such approximation by the Poiseuille's equation 6 that describes the viscous fluid as given below.

$$(\Delta V/\Delta t)=(1/G)\times(1/\eta)\{(\Delta P/\Delta x)\times S(x)\} \quad (6)$$

Here, the G is a form factor. Also, the fluid that flows along any pressure difference causes the viscosity resistance B. Therefore, it can be obtained by the following equation 7:

$$B=\int_0^L\{(G\times\eta)/S(x)\}\Delta x \quad (7)$$

Now, as understandable from the equation 7, if a duct flow path of pipe type is assumed with the density being given as ρ, the length as L, and the sectional area as So, the resistance (viscosity resistance) is expressed as follows:

$$B=8\eta\times L/(\pi\times So^2) \quad (8)$$

Thus, it is understandable that it is approximately proportional to the length of the nozzle, and is inversely proportional to the square of the sectional area of the nozzle.

As described above, in order to improve any one of the discharge characteristics of the liquid discharge head, the discharge speed, the discharge volume of ink droplet, the refilling time, in particular, it is prerequisite from the relations of the inertance that the amount of inertance from the heat to the discharge port side is made as larger as possible than the amount of inertance from the heater to the supply port side, and that the resistance in the nozzle is made small.

With respect to the view points described above, and to the objective that plural heaters and plural nozzles should be arranged in high density as well, the liquid discharge head of the present invention is the one, which is capable of satisfying both of them.

Next, with reference to the accompanying drawings, the description will be made of the specific structure of the liquid discharge head in accordance with the present embodiment.

As shown in FIG. 4 to FIG. 7, the liquid discharge head is provided with the element base plate 11 having heaters 20 serving as plural discharge energy-generating elements, which are the heat-generating resistive elements, and the orifice base plate 12, which forms plural ink flow paths by being laminated and bonded to the main surface of the element base plate 11.

The element base plate 11 is formed by, for example, glass, ceramics, resin, metal, or the like, which is generally formed by Si.

On the main surface of the element base plate 11, there are arranged for each of the ink flow paths, the heater 20, electrodes (not shown) that apply voltage to the heater 20, and wiring (not shown), which is connected with the electrodes, and arranged respectively by a predetermined wiring pattern. Also, on the main surface of the element base plate 11, the insulating film 21, which improves the dispersion of accumulated heat, is provided to cover the heater 20 (see FIG. 8A). Also, on the main surface of the element base plate 11, the protection film 22, which protects the main surface from the cavitation to be generated at the time of bubble extinction, is provided to cover the insulating film 21 (see FIG. 8A).

Figure 4:
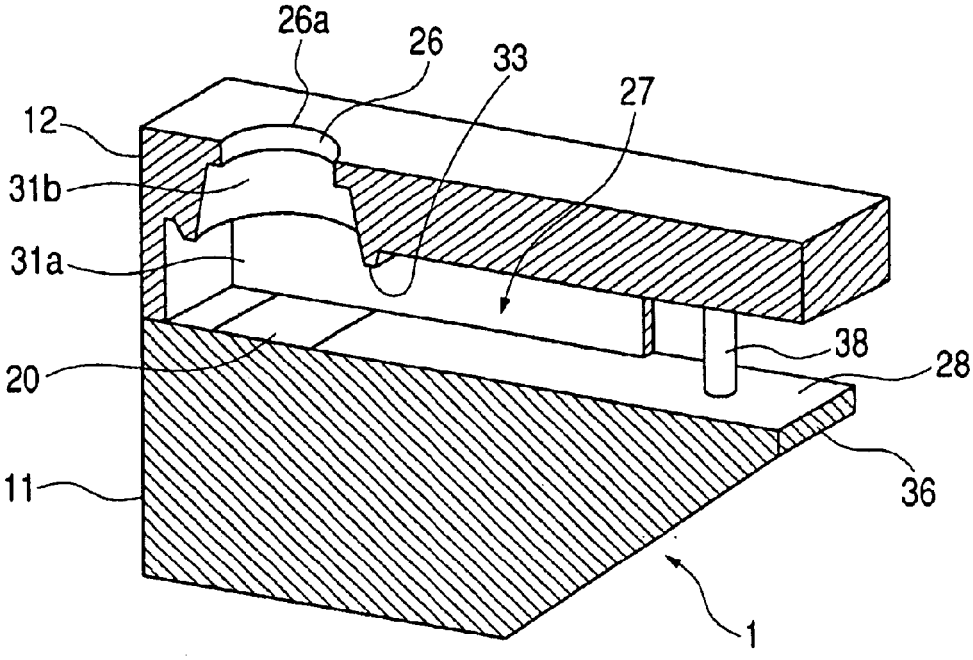
FIG. 4 is a partially sectional perspective view that illustrates the structure having one heater and nozzle combined therein for a liquid discharge head in accordance with a first embodiment of the present invention.
Figure 5:
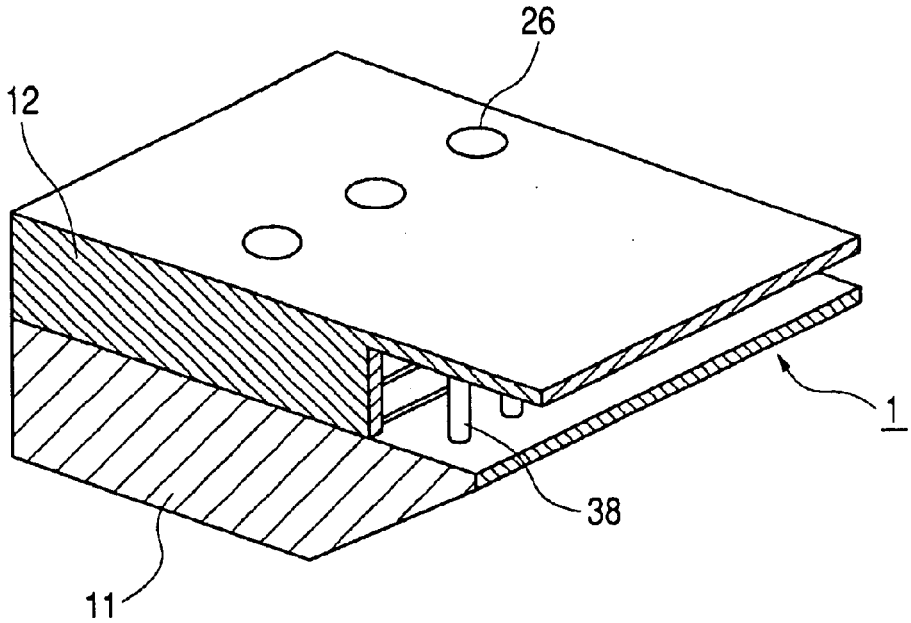
FIG. 5 is a partially sectional perspective view that illustrates the structure having plural heaters and nozzles combined therein for the liquid discharge head in accordance with the first embodiment of the present invention.
Figure 6:
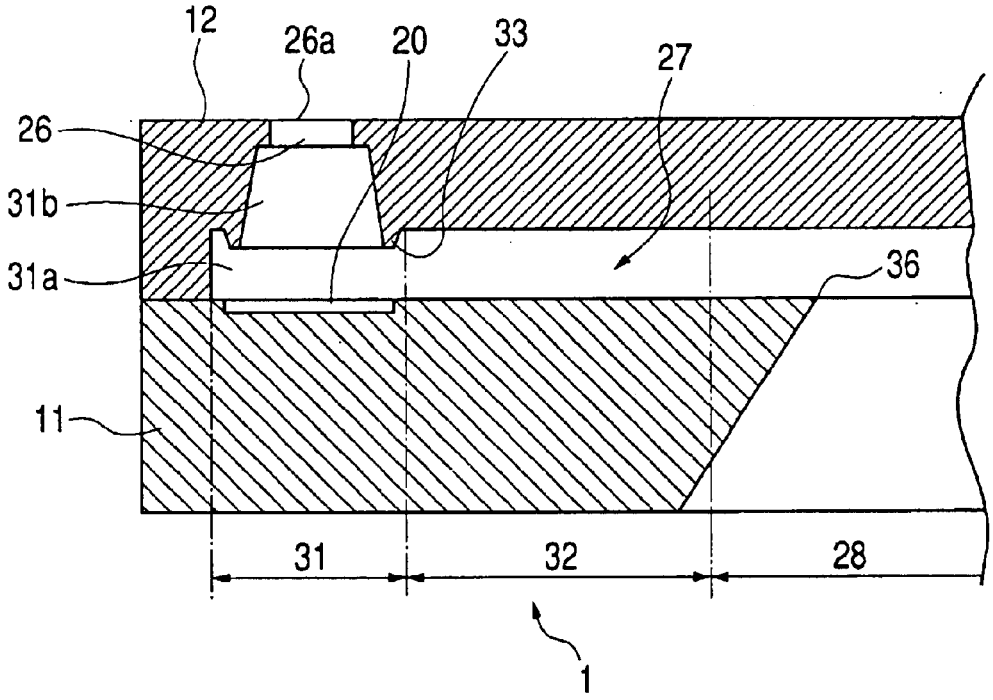
FIG. 6 is a side sectional view that illustrates the structure having one heater and nozzle combined therein for the liquid discharge head in accordance with the first embodiment of the present invention.

The orifice base plate 12 is formed by resin material in a thickness of approximately 30 μm. As shown in FIG. 4 and FIG. 5, the orifice plate 12 is provided with plural discharge port portions 26 for discharging ink droplets; plural nozzles 27, in which ink flows, respectively; and the supply chamber 28 that supplies ink to each of the nozzles 27. The nozzle 27 is provided with the discharge port portion 26 having discharge port 26*a* for discharging ink droplets; the bubbling chamber 31 that enable liquid in it to be bubbled by use of the heater 20 serving as the discharge energy-generating element; and the supply path 32 for supply liquid to the bubbling chamber 31.

The bubbling chamber 31 is formed by a first bubbling chamber 31*a* communicated with the supply path 32 as the bottom face of the main surface of the element base plate 11 for generating bubble in liquid in the bubbling chamber 31*a* by use of the heater 20, and a second bubbling chamber 31*b* communicated with the opening on the upper face of the first bubbling chamber 31*a*, which is in parallel to the main surface of the element base plate 11, and in which the bubble thus generated is developed. Then, for the circumferential portion on the upper face of the first bubbling chamber 31*a*, which is in parallel to the main surface of the element base plate 11 and in contact with the opening communicated with the second bubbling chamber 31*b*, an extrusion 33 is formed continuously to surround the opening in the direction toward the main surface of the element base plate 11.

The discharge port portion 26 is arranged to be communicated with the opening on the upper face of the second bubbling chamber 31*b*, and a difference in level is provided between the side wall face of the discharge port portion 26 and the side wall face of the second bubbling chamber 31*b*.

The discharge port 26*a* of the discharge port portion 26 is formed in the position facing the heater 20 provided for the element base plate 11. Here, it is formed to be a circular hole having a diameter of approximately 15 μm. In this respect, the discharge port 26*a* may be configured almost in the form of a star having spokes as required in terms of the discharge characteristics.

The second bubbling chamber 31*b* is formed to be a truncated cone, and the side wall thereof is contracted in the discharge port direction at an inclination of 10 to 45° to the plane orthogonal to the main surface of the element base plate. The upper face thereof is communicated with the opening of the discharge port portion 26 with a difference in level.

The first bubbling chamber 31*a* is on the extended line of the supply path 32, and the bottom end thereof facing the discharge port 26 is formed to be almost rectangular.

Here, the nozzle 27 is formed so that the shortest distance HO between the main surface of the heater 20 in parallel to the main surface of the element base plate 11, and the discharge port 26*a* is made to be 30 μm or less.

For the nozzles 27, the upper face of the first bubbling chamber 31*a* in parallel to the main surface, and the upper face in parallel to the main surface of the supply path 32 adjacent to the bubbling chamber 31 are continuous up to the supply chamber 8 on one and the same plane.

For the circumferential portion of the upper face of the first bubbling chamber 31*a* in parallel with the main surface of the element base plate 11, which is in contact with the opening communicated with the second bubbling chamber 31*b*, there is the extrusion 33 formed to surround the opening in the direction toward the main surface of the element base plate 11. This extrusion is provided with the function as a control portion to control ink to be caused to flow by bubble in the bubbling chamber 31.

It is formed to communicate one end of the supply path 32 the bubbling chamber 31, and the other end with the supply chamber 28.

In this way, the extrusion 33 that has function as the control portion is provided for the nozzle 27. Thus, the height to the main surface of the portion of the element base plate 11 across one end of the supply path 32 adjacent to the first bubbling chamber 31*a* is formed to be lower than the height of the other end of the supply path 32 adjacent to the supply chamber 28. Thus, with the provision of the extrusion 33 for the nozzle 27, it is made possible to form the sectional area of the ink flow path from the one end of the supply path 32 adjacent to the first bubbling chamber 31*a* to the first bubbling chamber 31*a* to be smaller than the sectional area of the other flow path.

Figure 7:
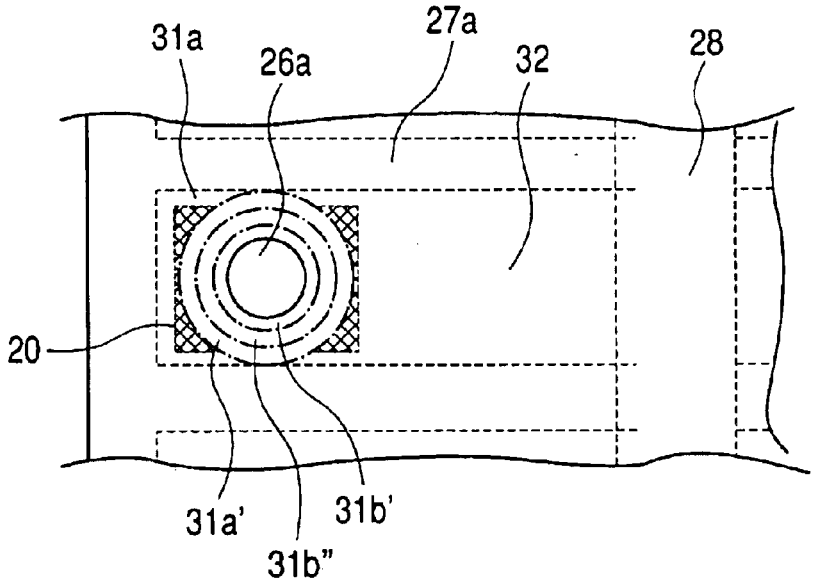
FIG. 7 is a plan sectional view that illustrates the structure having one heater and nozzle combined therein for the liquid discharge head in accordance with the first embodiment of the present invention.

Also, as shown in FIG. 4 and FIG. 7, the width of the nozzle 27, which is orthogonal to the ink flow direction on the face of the flow path in parallel to the main surface of the element base plate 11, is configured to be in the straight form substantially equal over the range from the supply chamber 28 to the bubbling chamber 31. Also, the inner wall faces of the nozzle 27 facing the main surface of the element base plate 11 are formed to be in parallel with the main surface of the element base plate 11 with the exception of the extrusion 33 over the range from the supply chamber 28 to the bubbling chamber 31. Here, for the nozzle 27, the height of the plane of the extrusion 33 facing the main surface of the element base plate 11 is formed to be approximately 10 μm, for example, and the height of the plane of the supply chamber 28 facing the main surface of the element base plate 11 is formed to be approximately 15 μm. Therefore, the height of the extrusion 33 is approximately 5 μm.

Also, for the back face of the main surface of the element base plate 11 adjacent to the orifice base plate 12, the supply port 36 is provided for supplying ink to the supply chamber 28 from this back face side.

Also, as shown in FIG. 4 and FIG. 5, there are arranged in the supply chamber 28, the column type nozzle filters 38, which stand across the element base plate 11 and the orifice base plate 12 per nozzle 27 in each position adjacent to the supply port 36 for filtering the dust particles in ink. The nozzle filter 38 is arranged in the position away from the supply port by approximately 20 μm, for example. Also, the gap between each of the nozzles 38 in the supply chamber 28 is approximately 10 μm, for example. By use of the filter 38, it becomes possible to prevent the supply path 38 and the discharge port 26 from being clogged by dust particles in order to assure operating discharges in good condition.

Now, the description will be made of the operation of discharging ink droplets from the discharge port 26 of the liquid discharge head 1 structured as described above.

At first, for the liquid discharge head 1, the ink, which is supplied from the supply port 36 into the supply chamber 28, is supplied into each nozzle 27 of the first and second nozzle arrays 16, and 17, respectively. The ink, which is supplied to each nozzle 27, flows along the supply path 32 to be filled in the bubbling chamber 31. The ink, which is filled in the bubbling chamber 31, is given film boiling by the heater 20, and flies in the direction almost orthogonal to the main surface of the element base plate 11 by means of the developing pressure of bubble thus generated. Thus, it is discharged as ink droplet from the discharge port 26*a* of the discharge portion 26.

When the ink, which is filled in the bubbling chamber 31, is discharged by way of the second bubbling chamber 32*b* by the developing pressure of the bubble generated by the film boiling given by the heater 20 in the first bubbling chamber 31*a*, the volume of ink is gradually reduced and the flow of ink is straightened (rectified) in the direction from the element base plate 11 toward the discharge port 26*a*, because the second bubbling chamber 31*b* is configured to be truncated cone, and the the side walls thereof are contracted in the direction toward the discharge port at an inclination of 10 to 45° to the plane orthogonal to the main surface of the element base plate, and then, the upper face thereof is communicated with the opening of the discharge port 26 with a difference in level. Thus, in the vicinity of the discharge port 26*a*, the liquid droplet flies, and the flying liquid droplet flies vertically to the base plate.

When the ink, which is filled in the bubbling chamber 31, is discharged, part of ink in the bubbling chamber 31 is caused to flow to the supply path 32 side due to the pressure of bubble generated in the bubbling chamber 31. In the liquid discharge head 1, when part of ink in the bubbling chamber 31 flows to the supply path 32 side, the extrusion 33 acts as fluid resistance to the ink, which flows from the bubbling chamber 31 side to the supply chamber 28 side through the supply path 32, because the flow passage of the supply path 32 is narrowed by the presence of the extrusion 33. As a result, in the liquid discharge head 1, the flow of ink filled in the bubbling chamber 31 to the supply path 32 side is suppressed by the extrusion 33. In this manner, the reduction of the amount of ink in the bubbling chamber 31 is prevented, thus reliably securing the volume of ink discharge in good condition. The occurrence of variation in the discharge volumes of liquid droplets to be discharged from the discharge port is then suppressed, and the discharge volume is kept appropriately.

For the liquid discharge head 1, given the inertance from the heater 20 to the discharge port 26 as $A_1$, the inertance from the heater 20 to the supply port 36 as $A_2$, and the inertance of the entire nozzle 27 as $A_0$, it is possible to express the energy distribution ratio $\eta$ to the discharge port 26 side of the head as follows:

$$\eta=(A_1/A_0)=\{A_2/(A_1+A_2)\} \quad (9).$$

Also, the value of each inertance may be obtainable by solving the Laplace equation by use of a three-dimensional finite constituent method solver.

From the aforesaid equation, the energy distribution ratio $\eta$ to the discharge port 26 side of the head for the liquid discharge head 1 is 0.59. The liquid discharge head 1 is capable of maintaining the values of the discharge speed and volume of discharge at the same level as the conventional ones by keeping the energy distribution ratio $\eta$ almost at the same value of the conventional liquid discharge head. Also, it is desirable to enable the energy distribution ratio $\eta$ to satisfy the relations of $0.5<\eta<0.8$. The liquid discharge head 1 is disabled to secure the discharge speed and discharge volume in good condition if the energy distribution ratio $\eta$ is 0.5 or less, and ink does not flow in good condition if it is 0.8 or more. Then, refilling cannot be performed any longer.

Also, when dyestuff-black ink (the surface tension: $47.8\times10^{-3}$ N/m, and the viscosity: 1.8 cp, pH 9.8) is used as ink for the liquid discharge head 1, it becomes possible to reduce the viscosity resistance value B in the nozzle 27 approximately by 40% as compared with the conventional liquid discharge head. The viscosity resistance value B may also be worked out by means of a three-dimensional constituent method solver, and with the establishment of the length of nozzle 27 and the sectional area of nozzle 27, it is possible to calculate this value of resistance easily.

Therefore, the liquid discharge head 1 of the present embodiment becomes capable of making the discharge speed faster than that of the conventional liquid discharge head approximately by 40%. Hence, the response capability of discharge frequency of approximately 25 to 30 kHz can be materialized.

Now, with reference to FIGS. 8A to 8E, and FIGS. 9A to 9E, and FIGS. 10A to 10D, the brief description will be made of a method for manufacturing the liquid discharge head 1 thus structured.

The method for manufacturing the liquid discharge head 1 is completed through a first step of forming an element base plate 11; a second step of forming the upper resin layer 42 and lower resin layer 41, respectively, to structure the ink flow path on the element base plate 11; a third step of forming the desired nozzle pattern on the upper resin layer 41; a fourth step of forming an inclination on the side face of the resin layer; and a fifth step of forming the desired nozzle pattern on the lower resin layer 42.

Next, in accordance with the method for manufacturing the liquid discharge head 1, a covering resin layer 43, which serves as the orifice base plate 12, is formed on the upper and lower resin layers 41 and 42 in a sixth step; the discharge port portion 26 is formed for the covering resin layer 43 in a seventh step; and the supply port 36 is formed on the element base plate 11 in an eighth step; and the upper and lower resin layers 41 and 42 are dissolved to flow out in a ninth step, thus manufacturing the liquid discharge head 1 through these steps.

Figure 8A:
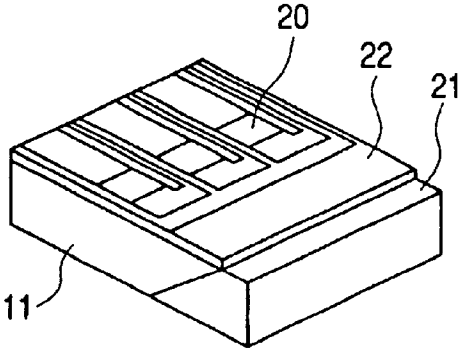
FIGS. 8A, 8B, 8C, 8D, and 8E are perspective views that illustrate a method for manufacturing the liquid discharge head in accordance with the first embodiment of the present invention.
Figure 9A:
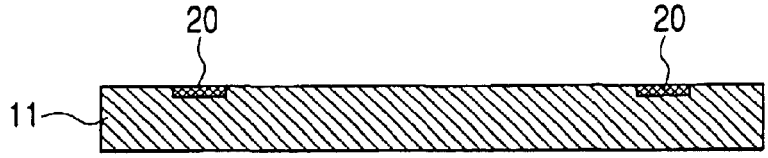
FIGS. 9A, 9B, 9C, 9D, and 9E are first vertical-sectional views that illustrate each step for manufacturing the liquid discharge head in accordance with the first embodiment of the present invention.

As shown in FIG. 8A and FIG. 9A, the first step is the formation process of the element base plate to form the element base plate 11 in such a manner that on the main surface of the Si chip, for example, plural heaters 20 and the predetermined wiring are provided by means of patterning process or the like in order to apply voltage to the heaters 20; an insulating film 21 is provided to cover the heaters 20 for the improvement of capability to disperse accumulated heat; and a protection film 22 is provided to cover the insulating film 21 in order to protect the main surface from the cavitation that occurs when the bubble extinction takes place.

Figure 8B:
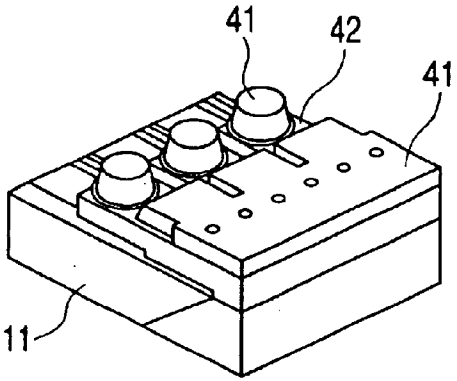
Figure 9B:
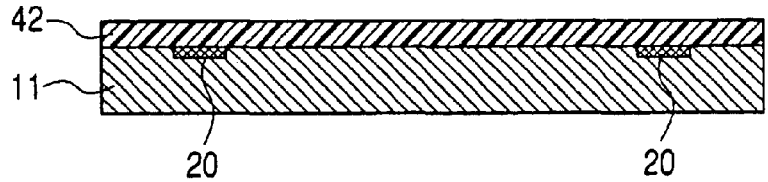
Figure 9C:
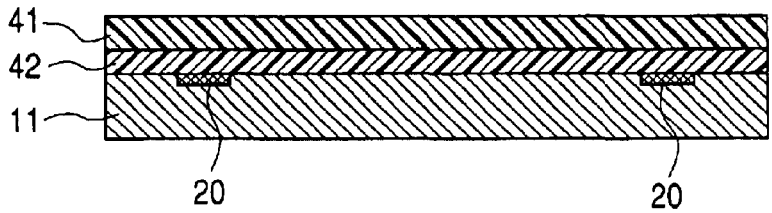
Figure 11:
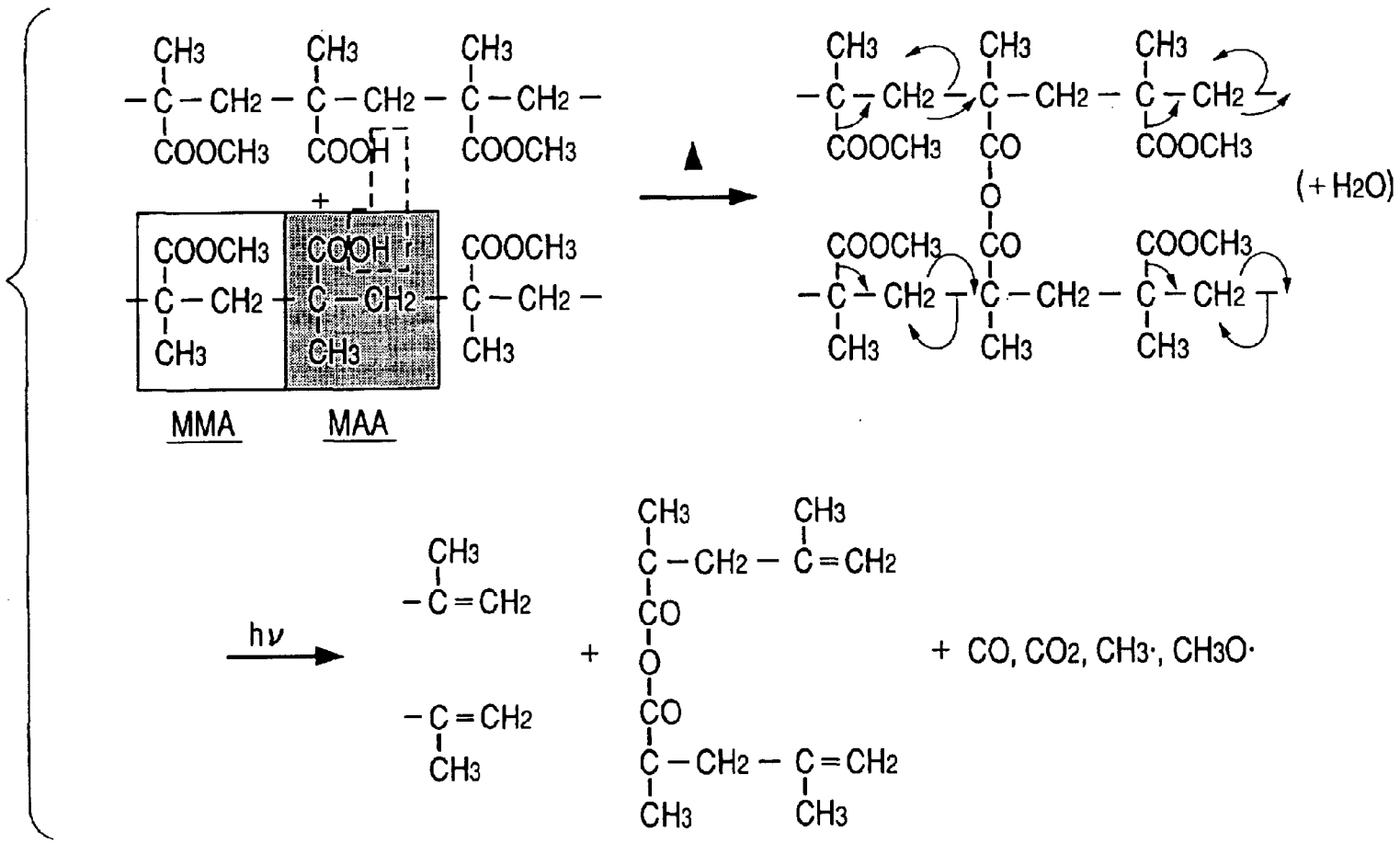
FIG. 11 is a view that shows the chemical formula to express the chemical changes of the upper resin layer and the lower layer by the irradiation of electron beam.

As shown in FIG. 8B, FIG. 9B, and FIG. 9C, the second step is the coating process in which Deep-UV light (hereinafter referred to as DUV light), which is the ultraviolet rays the wavelength of which is 300 nm or less, is irradiated onto the element base plate 11 so as to enable the dissolvable lower resin layer 42 and upper resin layer 41 to be continued when bindings in the molecules are destroyed, and then, each of them is coated by means of spin-coating method. In this coating step, when the upper resin layer 41 is coated by use of the spin-coating method, it is arranged to prevent the lower resin layer 42 and the upper resin layer 41 from being dissolved with each other by using the resin material of thermal bridging type made available by the reaction of dehydrated condensation as the lower resin layer 42. As the lower resin layer 42, methyl methacrylate (MMA) and methacrylic acid (MAA) are radically polymerized to obtain polymerized binary polymer (P (MMA-MAA)= 90:10), for example, and the liquid, which is obtainable by dissolving such polymer by cyclohexane solvent, is used. Also, for the upper resin layer 41, the liquid, which is obtainable by dissolving polymethyl isopropenyl ketone (PMIPK) with cyclohexanone solvent, is used. FIG. 11 is a view that shows the chemical reaction that forms the thermal-bridging film by the reaction of dehydrated condensation of the binary polymer (P (MMA-MAA)) used for the lower resin layer 42. This reaction of dehydrated condensation makes it possible to form the bridging film having higher strength by heating at a temperature of 180 to 200° C. for a period of 30 minutes to 2 hours. Here, the bridging film is in the form of indissoluble solvent. However, by the irradiation of electron beam, such as DUV light, decomposing reaction as shown in FIG. 11 occurs, and low molecular formation makes progress. Then, only the portion where the electron beam is irradiated becomes a dissoluble solvent.

Figure 9D:
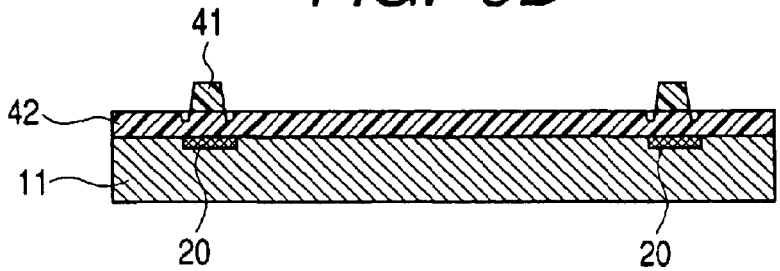
Figure 12:
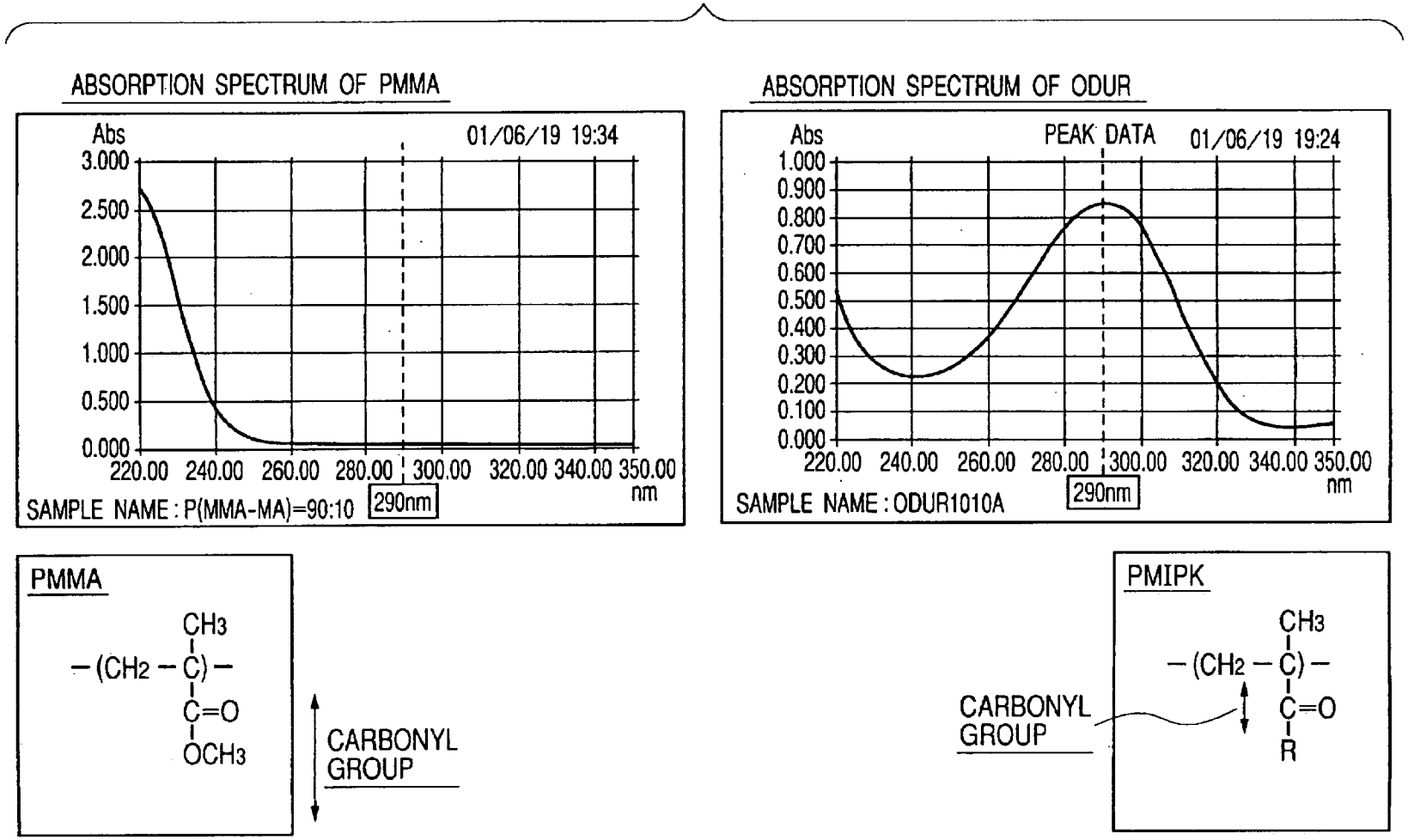
FIG. 12 shows the graphs of the absorption spectrum curves of the materials in the region of 210 to 330 nm of the lower resin layer and the upper resin layer.

As shown in FIG. 8B and FIG. 9D, the third step is the pattern formation process in which a filter is installed, as means for selecting wavelength, on the exposing device that irradiates DUV light, and cuts off the DUV light having the wavelength of less than 260 nm, and only the one having those of 260 nm or more is transmitted so as to enable the Near-UV light (hereinafter referred to as NUV) having the wavelength of around 260 to 330 nm to be irradiated onto the upper resin layer 41 to be exposed and developed for the formation of desired nozzle pattern thereon. In the third step, when the nozzle pattern is formed on the upper resin layer, there is the difference in sensitivity ratio of approximately 40:1 or more between the upper resin layer 41 and the lower resin layer 42 with respect to the NUV light having wavelength of around 260 to 330 nm. Therefore, the lower resin layer 42 is not exposed, and the P (MMA-MAA) of the lower resin layer 42 is not decomposed at all. Also, being the thermal bridging film, the lower resin layer 42 is not dissolved by developer, either, when the upper resin layer is developed. In this step, when development is performed, a step of forming a recessed portion 33', which becomes the continuous extrusion 33 later, is executed together for the lower resin layer 42 on the circumference of the organic resin pattern that forms the second bubbling chamber 31*b* at that time. FIG. 12 shows the absorption spectra of the materials of the lower resin layer 42 and the upper resin layer 41 in the region of 210 to 330 nm.

In the fourth step, as shown in FIG. 8B and FIG. 9D, the upper resin layer 41 is heated at a temperature of 140° C. for 5 to 20 minutes after the pattern formation, thus forming an inclination of 10 to 45° on the side face of the upper resin layer. This angle of inclination has interrelations with the pattern volume (shape and film thickness), and heating temperature and time, and control is possible to obtain a designated angle within the range of the aforesaid angles.

Figure 9E:
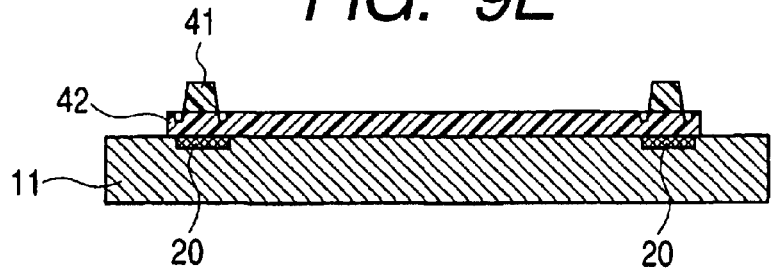

As shown in FIG. 8B and FIG. 9E, the fifth step is the pattern formation process in which the DUV light of wavelength 210 to 330 nm is irradiated using the aforesaid exposing device so as to enable the lower resin layer to be exposed and developed for the formation of desired nozzle pattern on the lower resin layer 42. Further, the P (MMA-MAA) material used for the lower resin layer 42 has high resolution, and even in a thickness of approximately 5 to 20 μm, it is possible to form the trench structure having the angle of inclination of approximately 0 to 5° on the sidewalls thereof. Also, if required, it is possible to form more inclination on the sidewalls of the lower resin layer 42 by heating the resin layer 42 after patterning at a temperature of approximately 120 to 140° C.

Figure 10A:
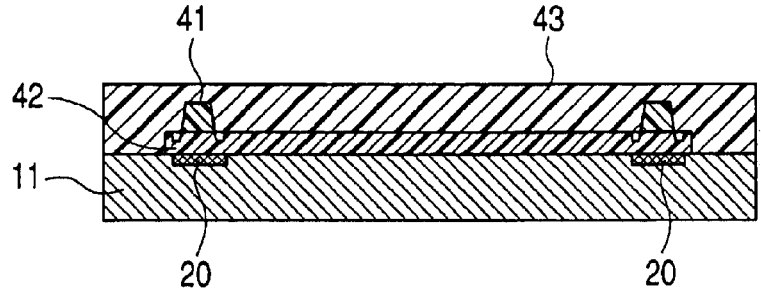
FIGS. 10A, 10B, 10C, and 10D are second vertical-sectional views that illustrate each step for manufacturing the liquid discharge head in accordance with the first embodiment of the present invention.

The sixth step is the coating process in which as shown in FIG. 10A, a transparent covering resin layer 43, which becomes the orifice base plate 12, is coated on the upper resin layer 41 and the lower resin layer 42 made dissolvable by the destruction of bridge binding in the molecules by the irradiation of DUV light.

Figure 8C:
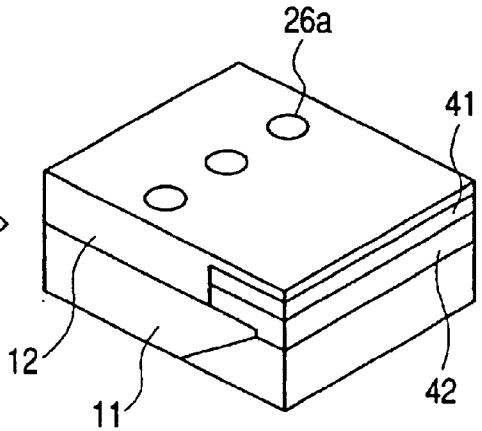
Figure 10B:
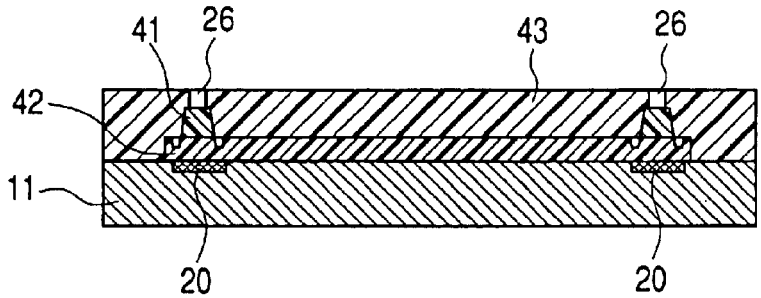

In the seventh step, as shown in FIG. 8C and FIG. 10B, the UV light is irradiated onto the covering resin layer 43 using the exposing device to enable the portion corresponding to the discharge port portion 26 to be exposed and developed for removal, thus forming the orifice base plate 12. The inclination on the sidewalls of the discharge port portion 26 to be formed for the orifice base plate 12 should desirably be formed as close as to 0° to the plane orthogonal to the main surface of the element base plate. However, if it is within a range of approximately 0 to 10°, there occurs no problem of any significance.

Figure 8D:
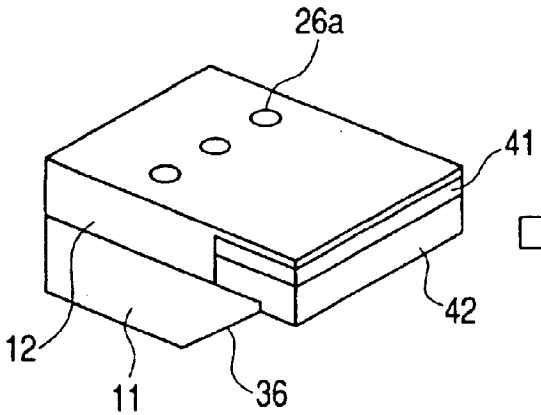
Figure 10C:
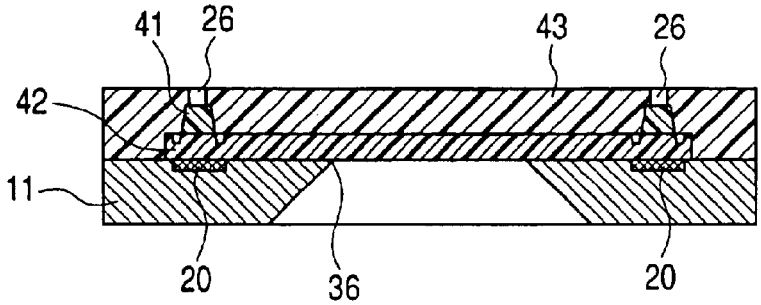

In the eighth step, as shown in FIG. 8D and FIG. 10C, chemical etching process and others are executed on the backside of the element base plate 11 to form the supply port 36 on the element base plate 11. As the chemical etching process, the anisotropic etching that uses strongly basic alkali liquid (KOH, NaOH, TMAH), is applicable, for example.

Figure 8E:
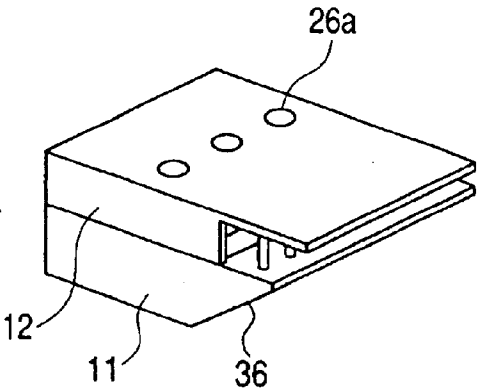
Figure 10D:
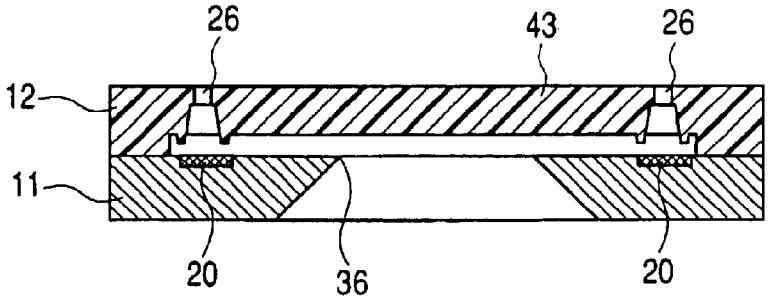

In the ninth step, as shown in FIG. 8E and FIG. 10D, the DUV light having wavelength of 330 nm or less is irradiated from the main surface side of the element base plate 11 and transmitted through the covering resin layer 43 so as to dissolve the upper and lower resin layers 41 and 42, which are the nozzle molding material positioned between the element base plate 11 and the orifice base plate 12, through the supply port 36, respectively.

In this way, it becomes possible to obtain the chip, which is provided with the discharge port 26*a*, the supply port 36, and the nozzle 27 having the extrusion 33 that serves as the control portion is formed with a difference in level for the supply path 32 communicated with those ports. Then, the liquid discharge head is obtained by electrically connecting this chip with a wired base plate (not shown) and others for driving the heater 20.

Here, in accordance with the method for manufacturing the liquid discharge head 1, if the upper resin layer 41 and the lower resin layer 42, which are made dissoluble by destroying the bridge binding in the molecules by the irradiation of the DUV light, are hierarchically structured in the thickness direction of the element base plate 11, it becomes possible to provide the control portion to be formed with three or more differences in level in the nozzle 27. For example, the resin material, which is sensitive to the light the wavelength of which is 400 nm or more, is used further for the upper layer side of the upper resin layer. Then, the multiply stepped nozzle structure can be formed.

Fundamentally, it is preferable for the method for manufacturing the liquid discharge head 1 of the present embodiment to follow the method for manufacturing a liquid discharge head adopting, as means for discharging ink, the ink jet recording method disclosed in the specifications of Japanese Patent Application Laid-Open No. 04-10940 and Japanese Patent Application Laid-Open No. 04-10941. The method disclosed in the aforesaid specifications of the patent application is the one in which ink droplets are discharged using the structure that enables the bubble generated by the heater to be communicated with the air outside. For example, then, a liquid discharge head, which is capable of discharging ink droplet in an extremely small amount of 50 pl or less, is provided.

For the liquid discharge head 1, bubble is communicated with the air outside. Therefore, the volume of ink droplet discharged from the discharge port 26 depends largely on the volume of ink positioned between the heater 20 and the discharge port 26, that is, the volume of ink filled in the bubbling chamber 31. In other words, the volume of ink droplet to be discharged is almost determined by the structure of the bubbling chamber 31 portion of the nozzle 27 of the liquid discharge head 1.

Consequently, the liquid discharge head 1 is made capable of outputting images in high quality without unevenness of ink. As the structure arranged for the liquid discharge head of the present invention, bubble is communicated with the air outside. Therefore, when applied to a liquid discharge head, the shortest distance between the heater and discharge port of which is 30 μm or less, it demonstrates the best effect. However, it can act effectively on any one of the liquid discharge heads if only the head should be arranged to enable ink droplet to fly in the direction orthogonal to the main surface of the element base plate where the heater is provided.

As described above, the liquid discharge head 1 is provided with the second bubbling chamber 31*b*, which is configured to be truncated cone. With this arrangement the volume of ink is gradually reduced and the flow of ink is made straight in the direction from the element base plate 11 toward the discharge port 26*a*, and in the vicinity of the discharge port 26*a*, the flying liquid droplet flies vertically with respect to the element base plate 11 when the liquid droplet flies. Also, with the provision of the extrusion 33 that controls the flow of ink in the bubbling chamber 31, it is attempted to stabilize the volume of ink droplet to be discharged, thus enhancing the discharge efficiency of ink droplets.

(Second Embodiment)

In accordance with the first embodiment, the second bubbling chamber 31*b*, which is configured to be in the form of truncated cone, is formed on the first bubbling chamber 31*a*, and the sidewalls of the second bubbling chamber 31*b* are inclined to the plane orthogonal to the main surface of the element base plate 11, and contracted in the direction toward the discharge port portion 26 at an inclination of 10 to 45°, and then, the structure is arranged so that on the circumferential portion of the upper face of the first bubbling chamber 31*a* in parallel with the main surface of the element base plate 11, which is in contact with the opening communicated with the second bubbling chamber 31*b*, the extrusion 33 that surrounds the opening and directed toward the main surface of the element base plate 11 is formed continuously. Here, for the liquid discharge head 2 in accordance with a second embodiment, the description will be made of the structure in which ink filled in the bubbling chamber is easier to flow to the discharge port. In this respect, for the liquid discharge head 2, the same reference marks are provided for the same members of the liquid discharge head 1 described above. The descriptions thereof will be omitted.

As in the first embodiment, the bubbling chamber 56 of the liquid discharge head 2 of the second embodiment is provided with the first bubbling chamber 56*a* in which bubble is generated by the heater 20, and the second bubbling chamber 56*b* arranged on the midway from the first bubbling chamber 56*a* to the discharge port portion 53. The structure is arranged so that the sidewalls of the second bubbling chamber 56*b* are inclined to the plane orthogonal to the main surface of the element base plate 11, and contracted in the direction toward the discharge port portion 26 at an inclination of 10 to 45°. Further, in the first bubbling chamber 56*a*, the wall faces, which are provided for partitioning individually each of the bubbling chambers 56*a* arranged in the plural number, are contracted at an inclination of 0 to 10° to the plane orthogonal to the main surface of the element base plate 11, and in the discharge port portion 53, these are contracted in the direction toward the discharge port 53*a* at an inclination of 0 to 5° to the plane orthogonal to the main surface of the element base plate 11.

Figure 13:
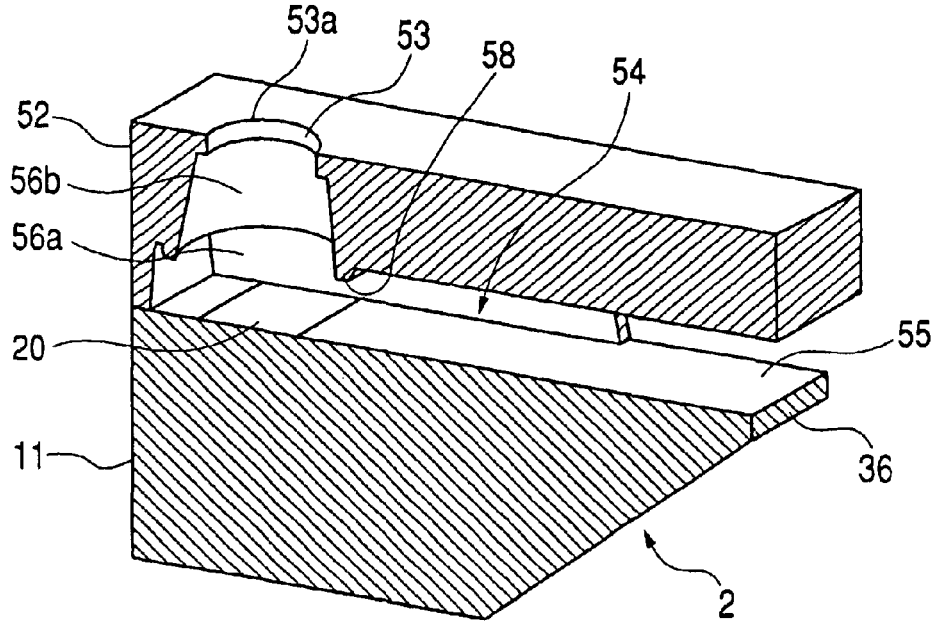
FIG. 13 is a partially sectional perspective view that illustrates the structure having one heater and nozzle combined therein for a liquid discharge head in accordance with a second embodiment of the present invention.
Figure 14:
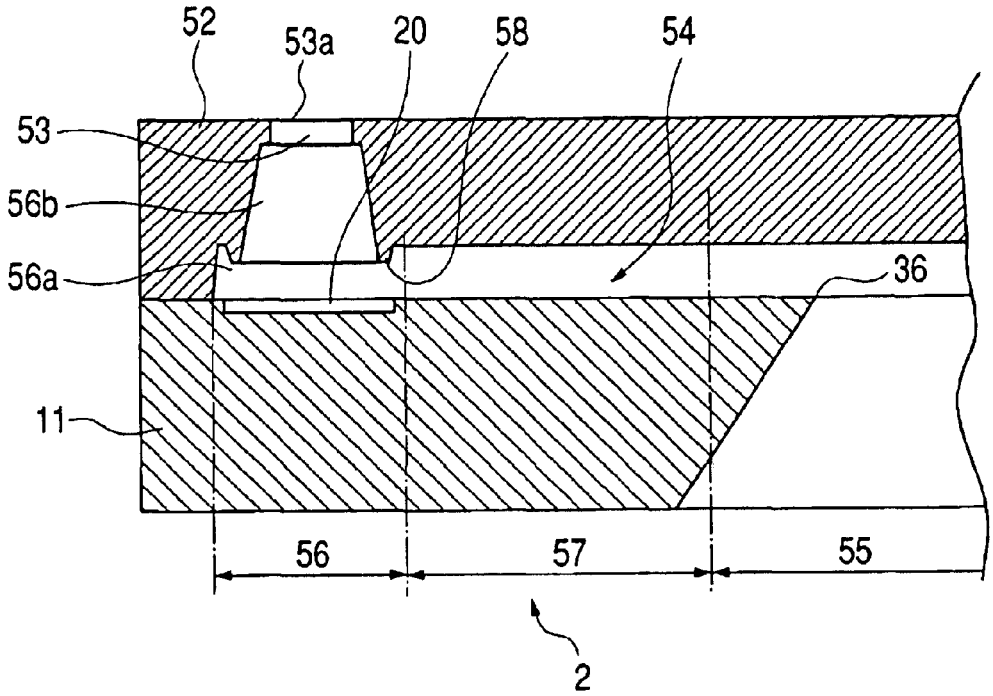
FIG. 14 is a side sectional view that illustrates the structure having one heater and nozzle combined therein for the liquid discharge head in accordance with the second embodiment of the present invention.

As shown in FIG. 13 and FIG. 14, the orifice base plate 52 provided with the liquid discharge head 2 is formed by resin material in a thickness of approximately 30 μm. As described earlier in conjunction with FIG. 1, the orifice base plate 52 is provided with plural discharge ports 53*a* for discharging ink droplets; plural nozzles 54 in which ink flows; and the supply chamber 55 for supplying ink to each of the nozzles 54.

The discharge port 53*a* is formed in a position facing the heater 20 on the element base plate 11, which is a circular hole having the diameter of approximately 15 μm. In this respect, the discharge port 53 may be configured almost in the form of a star having spokes as required in terms of the discharge characteristics.

The nozzle 54 is provided with the discharge port portion 53 having the discharge port 53*a* for discharging liquid droplet; the bubbling chamber 56, in which bubble is generated in the liquid therein by the heater 20 serving as the discharge energy generating element; and the supply path 57 for supplying liquid to the bubbling chamber 56.

The bubbling chamber 56 is provided with the first bubbling chamber 56*a* communicated with the supply path 57 as the bottom face of the main surface of the element base plate 11 for generating bubble in liquid therein by use of the heater 20, and a second bubbling chamber 56*b* communicated with the opening on the upper face of the first bubbling chamber 56*a* in parallel with the main surface of the element base plate 11, in which the bubble generated in the first bubbling chamber 56*a* is developed. Then, for the circumferential portion on the upper face of the first bubbling chamber 56*a*, which is in parallel to the main surface of the element base plate 11 and in contact with the opening communicated with the second bubbling chamber 56*b*, an extrusion 33 is formed continuously to surround the opening in the direction toward the main surface of the element base plate 11.

The discharge port portion 53 is arranged to be communicated with the opening on the upper face of the second bubbling chamber 56*b*, and a difference in level is provided between the sidewall face of the discharge port portion 53 and the sidewall face of the second bubbling chamber 56*b*.

The bottom end of the first bubbling chamber 56*a*, which faces the discharge port 53*a*, is formed to be almost rectangular. Also, the first bubbling chamber 56*a* is formed so that the shortest distance OH between the heater 20 in parallel to the main surface of the element base plate 11, and the discharge port 53*a* becomes 30 μm or less. As described earlier in conjunction with FIG. 1, the heater 20 is arranged in the plural number on the element base plate 11, and when the arrangement density is 600 dpi, the pitch between each of the heaters is approximately 42.5 μm. Then, if the width of the first bubbling chamber 56*a* in the arrangement direction of heater is formed to be 35 μm, the width of nozzle wall that shields between each of the heaters is approximately 7.5 μm. The height of the first bubbling chamber 56*a* from the surface of the element base plate 11 is 10 μm. The height of the second bubbling chamber 56*b* formed on the first bubbling chamber 56*a* is 15 μm. The height of the discharge port portion 53 formed for the orifice base plate 52 is 5 μm. The discharge port 53*a* is configured to be circular, the diameter of which is 15 μm. The second bubbling chamber 56*b* is configured to be truncated cone, and if the diameter of the bottom, which is in contact with the first bubbling chamber 56*a* is 30 μm, the diameter of the upper face on the discharge port portion 53 side is 19 μm, provided that the sidewall of the second bubbling chamber is formed at an inclination of 20°. Then, there is a difference in level of approximately 2 μm, and connection is made with the discharge port portion 53 having the diameter of 15 μm.

The height of the extrusion 33, which is formed on the circumferential portion of the upper face of the first bubbling chamber 56*a* in parallel with the main surface of the element base plate 11, and in contact with the opening communicated with the second bubbling chamber 56*b*, surrounding the opening in the direction toward the main surface of the element base plate 11, is 3 μm.

The bubble, which is generated in the first bubbling chamber 56*a* is developed toward the second bubbling chamber 56*b* and the supply path 57, and the flow of ink filled in the nozzle 54 is straightened at the discharge port portion 53. Thus, ink flies from the discharge port 53*a* arranged for the orifice base plate.

The supply path 57 is formed so as to enable one end thereof to be communicated with the bubbling chamber 56, and the end to be communicated with the supply chamber 55.

Here, for the sidewall of the second bubbling chamber 56*b*, a larger inclination is provided, and also, an inclination is provided for the first bubbling chamber 56*a*. With this arrangement, then, the ink, which is filled in the nozzle, is allowed to move more efficiently to the discharge port portion 53 by bubble generated in the first bubbling chamber 56*a*. However, although the first bubbling chamber 56*a*, the second bubbling chamber 56*b*, and the discharge port portion 53 are all formed in good precision by means of photolithographic process, these are not necessarily formed exactly without any deviation. There are errors of submicron order in the alignments thereof. Therefore, in order to enable ink to fly straightly in the direction orthogonal to the main surface of the element base plate 11, it is necessary for the discharge port portion 53 to straighten the flow of ink for the exact flying direction. For that matter, the inclination of sidewalls of the discharge port portion 53 should be in parallel with the direction orthogonal to the main surface of the element base plate as much as possible. In other words, it is desirable to make the inclination at a value as close as to 0°.

Here, however, in order to make the flying droplet as smaller as possible, it is necessary to make the area of the opening smaller still. As a result, if the height (length) of the discharge port portion 53 becomes larger than the opening, the viscosity resistance of ink increases extremely at such portion, which may lead to the deterioration of the discharge characteristics of flying ink. Therefore, for the liquid discharge head 2 of the second embodiment, it is arranged to enable the bubble generated in the first bubbling chamber to be developed more easily up to the second bubbling chamber, and also, to make the flowability of ink filled in the nozzle better in the second bubbling chamber. Further, the structure is arranged to execute the flow-straightening function for flying ink in the discharge direction. Here, although depending on the distance from the surface of the element base plate 11 to the discharge port 53*a*, it is desirable to set the height of the second bubbling chamber to be approximately 3 to 25 μm, more desirably, approximately 5 to 15 μm, and also, it is desirable to set the length of the discharge port portion 53 to be approximately 1 to 10 μm, more desirably, approximately 1 to 3 μm.

Also, as shown in FIG. 13, the nozzle 54 is configured to be almost in the straight form, in which while it is orthogonal to the ink flow path, the width of the flow path in parallel with the main surface of the element base plate 11 is almost equal across the supply chamber 55 to the bubbling chamber 56. Also, each of the inner wall faces of the nozzle 54 facing the main surface of the element base plate 11 is formed to be in parallel with the main surface of the element base plate 11 across the supply chamber 55 to the bubbling chamber 56, respectively. Now, the description will be made of the operation of discharging ink droplets from the discharge port 53*a* of the liquid discharge head 2 structured as described above.

At first, for the liquid discharge head 2, the ink, which is supplied from the supply port 36 into the supply chamber 55, is supplied into each nozzle 54 of the first and second nozzle arrays, respectively. The ink, which is supplied to each nozzle 54, flows along the supply path 57 to be filled in the bubbling chamber 56. The ink, which is filled in the bubbling chamber 56, is given film boiling by the heater 20, and flies in the direction almost orthogonal to the main surface of the element base plate 11 by means of the developing pressure of bubble thus generated. Thus, it is discharged as ink droplet from the discharge port 53*a*.

When the ink, which is filled in the bubbling chamber 56, is discharged, part of ink in the bubbling chamber 56 is caused to flow to the supply path 57 side by the pressure of bubble generated in the bubbling chamber 56. In the liquid discharge head 2, the pressure of bubble generated in the first bubbling chamber 56*a* is propagated instantaneously to the second bubbling chamber 56*b*, and ink filled in the first and second bubbling chambers 56*a* and 56*b* moves in the second bubbling chamber 56*b*. At this juncture, since the inner walls are inclined, the bubble, which is being developed in the first and second bubbling chambers 56*a* and 56*b*, abuts against the inner walls. Therefore, the pressure loss is small, and the bubble is developed toward the discharge port 53*a* in good condition. Then, the ink, the flow of which is straightened in the discharge port portion 53, is allowed to fly from the discharge port 53*a* arranged for the orifice base plate 52 in the direction orthogonal to the main surface of the element base plate 11. Also, the discharge volume of ink droplet is secured in good condition. As a result, the liquid discharge head 2 is made capable of making the discharge speed higher for the ink droplets to be discharged from the discharge port 53*a*. Therefore, as compared with the conventional liquid discharge head, it is possible for the liquid discharge head 2 to enhance the kinetic energy of ink droplet, which is worked out from the discharge speed and the volume of discharge. Hence, wile the discharge efficiency is improved, the characteristics of discharge frequency is made higher as in the case of the liquid discharge head 1 described earlier.

Now, the brief description will be made of the method for manufacturing the liquid discharge head 2 structured as described above. The method of manufacture for the liquid discharge head 2 is almost the same as the method of manufacture for the liquid discharge head 1 described earlier. Therefore, while the same reference marks are applied to the same members, the description of the same steps of manufacture will be omitted.

The method of manufacture for the liquid discharge head 2 follows the method of manufacture for the liquid discharge head 1 described earlier. As shown in FIG. 8A and FIG. 9A, the first step is the formation process of the base plate to form the element base plate 11 by providing plural heaters 20 and the predetermined wiring for applying voltage to those heaters 20 on the Si chip, for example, by means of patterning process and the like.

As shown in FIG. 8B, FIG. 9B, and FIG. 9C, the second step is the coating process in which the DUV light, which is the ultraviolet rays having the wavelength of 330 nm or less, is irradiated onto the element base plate 11 so as to enable the dissolvable lower resin layer 42 and upper resin layer 41 to be continued when bindings in the molecules are destroyed, and then, each of them is coated by means of spin-coating method. In this coating step, the film thickness of the lower resin layer 42 is 10 μm, and the upper resin layer 41 is 15 μm.

As shown in FIG. 8B and FIG. 9D, the third step is the pattern formation process in which a filter is installed, as means for selecting wavelength, on the exposing device that irradiates DUV light, and cuts off the DUV light having the wavelength of less than 260 nm, and only the one having those of 260 nm or more is transmitted so as to enable the NUV light having the wavelength of around 260 to 330 nm to be irradiated onto the upper resin layer 41 to be exposed and developed for the formation of desired nozzle pattern on the upper bubbling layer 41. In this step, when development is performed, a step of forming a recessed portion 33', which becomes the continuous extrusion 33 later, is executed together for the lower resin layer 42 on the circumference of the organic resin pattern that forms the second bubbling chamber 56*b* at that time.

In the fourth step, as shown in FIG. 8B and FIG. 9D, the upper resin layer 41 is heated at a temperature of 140° C. for 10 minutes after the pattern formation, thus forming an inclination of 20° on the side face of the upper resin layer 41.

As shown in FIG. 8B and FIG. 9E, the fifth step is the pattern formation process in which the DUV light of wavelength 210 to 330 nm is irradiated using the aforesaid exposing device so as to enable the lower resin layer 42 to be exposed and developed for the formation of desired nozzle pattern on the lower resin layer 42.

The sixth step is the coating process in which as shown in FIG. 10A, a transparent covering resin layer 43, which becomes the orifice base plate 12, is coated on the upper resin layer 41 and the lower resin layer 42 made dissolvable by the destruction of bridge binding in the molecules by the irradiation of DUV light. The film thickness of the covering resin layer 43 is 30 μm.

In the seventh step, as shown in FIG. 8C and FIG. 10B, the UV light is irradiated onto the covering resin layer 43 using the exposing device to enable the portion corresponding to the discharge port portion 53 to be exposed and developed for removal, thus forming the orifice base plate 52. The length of the discharge port portion 53 is 5 μm.

In the eighth step, as shown in FIG. 8D and FIG. 10C, chemical etching process and others are executed on the backside of the element base plate 11 to form the supply port 36 on the element base plate 11. As the chemical etching process, the anisotropic etching that uses strongly basic alkali solution (KOH, NaOH, TMAH), is applicable, for example.

In the ninth step, as shown in FIG. 8E and FIG. 10D, the DUV light having wavelength of 330 nm or less is irradiated from the main surface side of the element base plate 11 and transmitted through the covering resin layer 43 so as to dissolve the upper and lower resin layers 41 and 42, which are the nozzle molding material positioned between the element base plate 11 and the orifice base plate 52, respectively.

In this way, it becomes possible to obtain the chip, which is provided with the discharge port 53*a*, the supply port 36, and the nozzle 54 having the control portion 58 formed with a difference in level for the supply path 57 communicated with them. Then, the liquid discharge head 2 is obtained by electrically connecting this chip with a wired base plate (not shown) and others for driving the heater 20.

As described above, the liquid discharge head 2 is provided with the second bubbling chamber 56*b* configured to be truncated cone, and then, the wall face of the first bubbling chamber 56*a* is inclined so as to straighten the flow of ink with the gradual reduction of the volume thereof in the direction from the element base plate 11 toward the discharge port 53*a*. In the vicinity of the discharge port 53*a*, the flying liquid droplet flies vertically to the element base plate 11 when the liquid droplet flies. Also, with the provision of the extrusion 58 for controlling the flow of ink in the bubbling chamber 56, it becomes possible to stabilize the volume of ink droplet to be discharged, thus enhancing the discharge efficiency of ink droplets.

(Third Embodiment)

With reference to the accompanying drawings, the brief description will be made of the liquid discharge head 3 in accordance with a third embodiment. Here, the height of the first bubbling chamber of the liquid discharge head 2 described above is made smaller still, and the height of the second bubbling chamber thereof is made larger. In this respect, for the liquid discharge head 3, the same reference marks are applied to the same members of the liquid discharge heads 1 and 2 described earlier, and the description thereof will be omitted. As in the first embodiment, the bubbling chamber 66 of the liquid discharge head 3 of the third embodiment is provided with the first bubbling chamber 66*a* in which bubble is generated by the heater 20, and the second bubbling chamber 66*b* arranged on the midway from the first bubbling chamber 66*a* to the discharge port portion 63. The structure is arranged so that the sidewalls of the second bubbling chamber 66*b* are inclined to the plane orthogonal to the main surface of the element base plate 11, and contracted in the direction toward the discharge port portion 63 at an inclination of 10 to 45°. Further, in the first bubbling chamber 66*a*, the wall faces, which are provided for partitioning individually each of the bubbling chambers 66*a* arranged in the plural number, are contracted at an inclination of 0 to 10° to the plane orthogonal to the main surface of the element base plate 11, and in the discharge port portion 63, these are contracted in the direction toward the discharge port 63*a* at an inclination of 0 to 5° to the plane orthogonal to the main surface of the element base plate 11.

On the circumferential portion on the upper face of the first bubbling chamber 66*a* in parallel with the main surface of the element base plate 11, which is communicated with the second bubbling chamber 66*b*, the extrusion 33 is formed continuously to surround the opening thereof in the direction toward the main surface of the element base plate 11.

Figure 15:
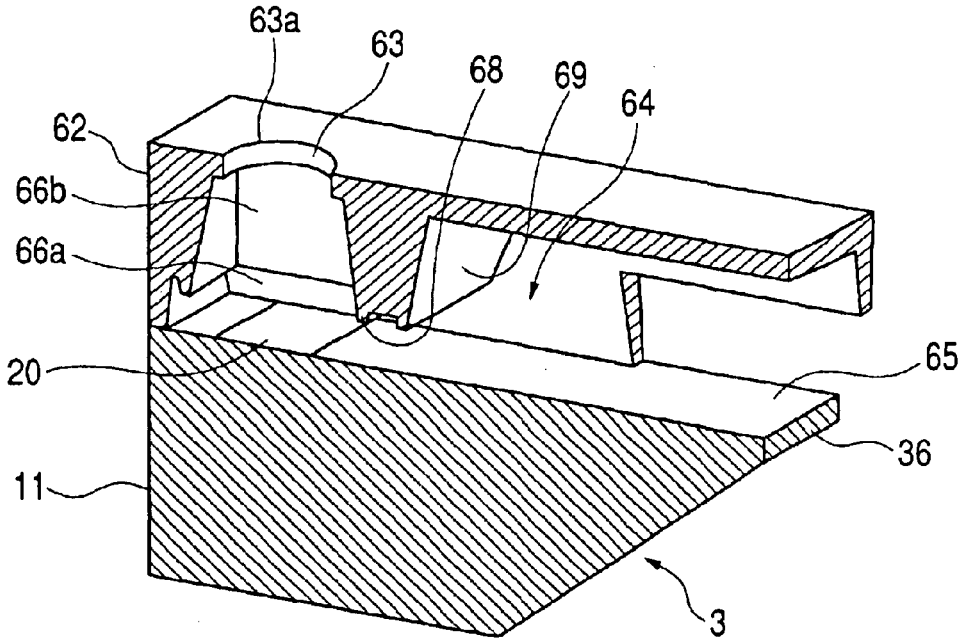
FIG. 15 is a partially sectional perspective view that illustrates the structure having one heater and nozzle combined therein for a liquid discharge head in accordance with a third embodiment of the present invention.
Figure 16:
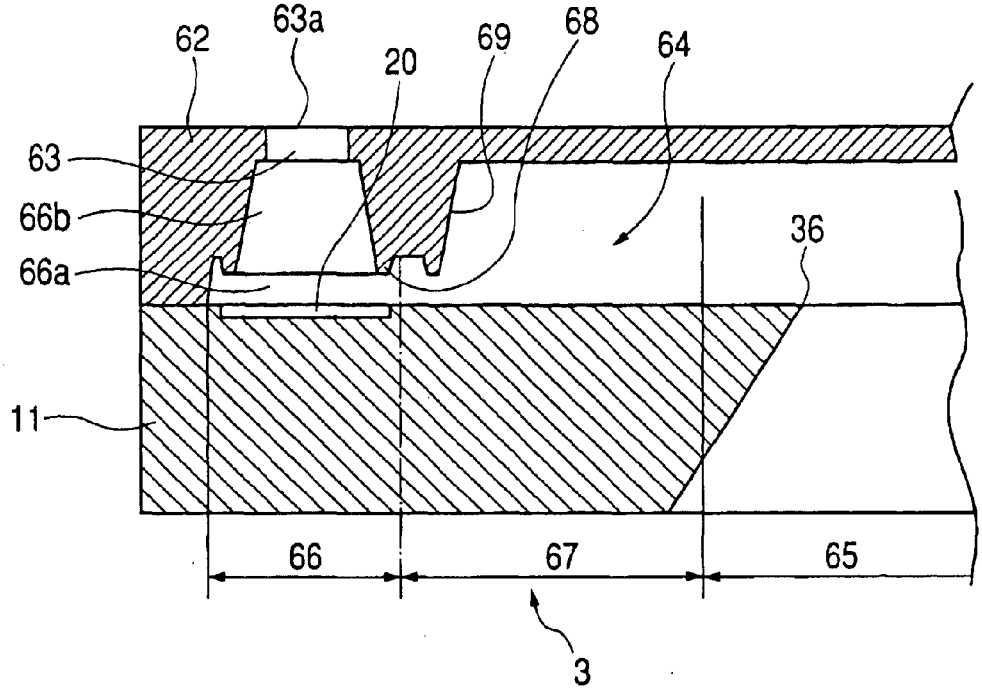
FIG. 16 is a side sectional view that illustrates the structure having one heater and nozzle combined therein for the liquid discharge head in accordance with the third embodiment of the present invention.

As shown in FIG. 15 and FIG. 16, the orifice base plate 62 provided with the liquid discharge head 3 is formed by resin material in a thickness of approximately 30 μm. As described earlier in conjunction with FIG. 1, the orifice base plate 62 is provided with plural discharge ports 63 for discharging ink droplets; plural nozzles 64 in which ink flows; and the supply chamber 65 for supplying ink to each of the nozzles 64.

The discharge port 63*a* is formed in a position facing the heater 20 on the element base plate 11, which is a circular hole having the diameter of approximately 15 μm. In this respect, the discharge port 63*a* may be configured almost in the form of a star having spokes as required in terms of the discharge characteristics.

The bottom end of the first bubbling chamber 66*a*, which faces the discharge port 63*a*, is configured to be almost rectangular. Also, the first bubbling chamber 66*a* is formed so as to make the shortest distance OH between the discharge port 63*a*, and the main surface of the heater 20 in parallel with the mine surface of the element base plate 11 to be 30 μm or less. The height from the surface of the element base plate 11 on the upper face of the first bubbling chamber 66*a* is formed to be 8 μm, for example, and the height of the second bubbling chamber 66*b*, which is provided on the first bubbling chamber 66*a*, is formed to be 18 μm. The second bubbling chamber 66*b* is configured to be square-truncated cone, and the length of one side of the first bubbling chamber 66*a* side is 28 μm. For the corners, an R of 2 μm is formed, respectively. Then, the sidewalls of the second bubbling chamber 66*b* are inclined at an angle of 15° to the plane orthogonal to the main surface of the element base plate 11 so as to be contracted in the direction toward the discharge port portion 63 side. Then, the upper face of the second bubbling chamber 66*b*, and the discharge port portion 63 the diameter of which is 15 μm are communicated with a difference in level of approximately 1.7 μm at the minimum.

The height of the discharge portion 63 where the orifice base plate 62 is formed is 4 μm. The discharge port 63*a* is circular having the diameter of 15 μm.

The height of extrusion 33 is 2 μm. The extrusion is formed in the direction toward the main surface of the element base plate 11 on the circumferential portion on the upper face of the first bubbling chamber 66*a*, which is in parallel with the main surface of the element base plate 11, and the extrusion is in contact with, and surrounds the opening communicated with the second bubbling chamber 66*b*.

The bubble, which is generated in the first bubbling chamber 66*a*, is developed toward the second bubbling chamber 66*b* and the supply path 67. Then, the flow of the ink, which is filled in the nozzle 64, is straightened in the discharge port portion 63, and flies from the discharge port 63*a* arranged for the orifice base plate 62.

The supply path 67 is formed so as to enable one end thereof to be communicated with the bubbling chamber 66, and the other end to be communicated with the supply chamber 65.

The upper face of the surface bubbling chamber 66*a* in parallel with the main surface, and the upper face of the supply path 67 adjacent to the bubbling chamber 66 in parallel with the main surface are made continuous on one and the same plane, and connected with the upper face of the supply path 67 on the supply chamber 65 side, which is higher than that, and in parallel with the main surface of the element base plate 11, by means of a difference in level 69 formed by inclination toward the main surface. Then, on the lower end of the portion having a difference in level, the extrusion is arranged. The region between the difference in level 69 and the extrusion 68 to be in contact with the first bubbling chamber 66*a* also constitutes a control portion, which controls, in cooperation with the extrusion 68, the ink that flows in the bubbling chamber 66 by bubble. Here, as in the cases of the first and second embodiments, it may be possible to continue the upper face from the bubbling chamber 66 to the supply chamber 65, which is in parallel with the main surface, by one and the same plane without providing any difference in level.

The first bubbling chamber 66*a* is formed on the element base plate. With the height thereof being made smaller, it becomes possible to make the sectional area smaller for the ink flow path across the one end portion of the supply path 67 adjacent to the first bubbling chamber 66*a* and the first bubbling chamber 66*a*. As a result, this sectional area is made smaller still than that of the nozzle 54 of the liquid discharge head 2 of the second embodiment.

On the other hand, with the height of the second bubbling chamber 66*b* being made larger, it becomes easier for the pressure of bubble generated in the first bubbling chamber 66*a* to be propagated to the second bubbling chamber 66*b*. Then, the propagation thereof to the supply path 67, which is communicated with the one end of the first bubbling chamber 66*a*, is made difficult. As a result, the movement of ink to the discharge port 63 is made faster and more efficiently.

Also, the nozzle 64 is configured to be in a straight form, and the width of flow path thereof, which is in parallel with the main surface of the element base plate 11, while being orthogonal to the ink flow direction, is made substantially equal across the supply chamber 65 and the bubbling chamber 66. Also, each of the inner wall faces of the nozzle 64, which faces the main surface of the element base plate 11, is formed in parallel with the main surface of the element base plate 11, respectively, across the supply chamber 65 and the bubbling chamber 66.

Now, the description will be made of the ink discharge operation from the discharge port 63 of the liquid discharge head 3 structured as described above. At first, for the liquid discharge head 3, the ink, which is supplied from the supply port 36 into the supply chamber 65, is supplied into each nozzle 64 of the first and second nozzle arrays, respectively. The ink, which is supplied to each nozzle 64, flows along the supply path 67 to be filled in the bubbling chamber 66. The ink, which is filled in the bubbling chamber 66, is given film boiling by the heater 20, and flies in the direction almost orthogonal to the main surface of the element base plate 11 by means of the developing pressure of bubble thus generated. Thus, it is discharged as ink droplet from the discharge port 63.

When the ink, which is filled in the bubbling chamber 66, is discharged, part of ink in the bubbling chamber 66 is caused to flow to the supply path 67 side due to the pressure of bubble generated in the first bubbling chamber 66*a*. The height of the first bubbling chamber 66*a* of the liquid discharge head 3 is made smaller, the ink flow path of the supply path 67 is made narrower still. Therefore, when part of ink in the first bubbling chamber 66*a* is caused to flow to the supply path 67 side, the fluid resistance of the flow path of supply path 67 is increased against the ink that flows toward the supply chamber 65 side from the first bubbling chamber 66*a* side through the supply path 67. As a result, it is made possible for the liquid discharge head 3 to suppress more the flow of the ink, which is filled in the bubbling chamber 66, to the supply path 67 side. Thus, the development of bubble from the first bubbling chamber 66*a* to the second bubbling chamber 66*b* is further promoted to make the flowability of ink easier to be transferred to the discharge port side. In this manner, the volume of ink discharge is secured more reliably.

Also, for the liquid discharge head 3, the pressure of bubble propagated from the first bubbling chamber 66*a* to the second bubbling chamber 66*b* becomes more efficient, and with the inclinations of the wall faces of the first bubbling chamber 66*a* and second bubbling chamber 66*b*, it is made possible to suppress the pressure loss of the bubble developed in the first bubbling chamber 66*a* and second bubbling chamber 66*b*, which may be incurred when the developing bubble abuts against the inner walls of the bubbling chamber 66. As a result, bubble is developed in good condition. Thus, for the liquid discharge head 3, the discharge speed of ink from the discharge port 63 is enhanced.

In accordance with the liquid discharge head 3 described above, the movement of ink in the first bubbling chamber 66*a* and second bubbling chamber 66*b* is made faster, and resistance thereto is more reduced. Also, with the length of the discharge port portion being made smaller, the straightening action of ink flow is made more promptly than the liquid discharge heads 1 and 2, and the discharge efficiency of ink droplets is further enhanced accordingly.

(Fourth Embodiment)

Lastly, with reference to the accompanying drawings, the description will be made of the liquid discharge head 4 in accordance with a fourth embodiment. In this respect, whereas each nozzle of the first nozzle array 16 and second nozzle array 17 of the aforesaid liquid discharge heads 1 to 3 is formed equally, the shapes and heater areas of the first nozzle array and second nozzle array are different from each other.

Figure 17A:
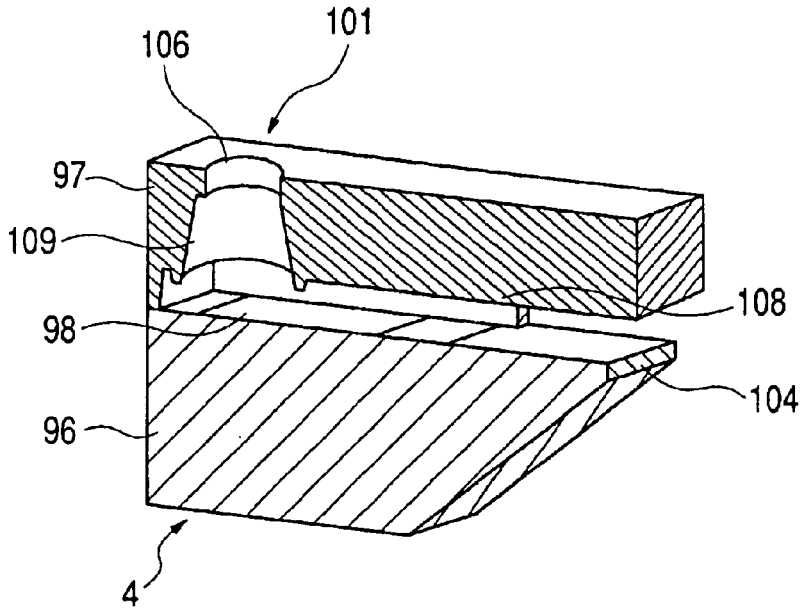
FIGS. 17A and 17B are partially sectional perspective views that illustrate a structure having one heater and nozzle combined therein for a liquid discharge head in accordance with a fourth embodiment of the present invention.
Figure 17B:
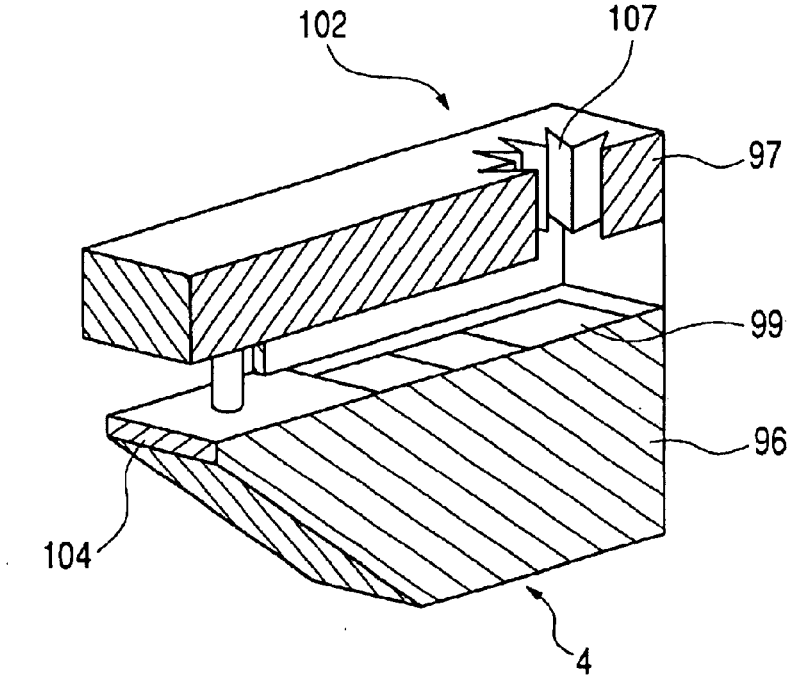

As shown in FIGS. 17A and 17B, the element base plate 96 of the liquid discharge head 4 is provided with the first and second heaters 98 and 99 having the areas in parallel with the main surface of the element base plate but different from each other, respectively.

Also, for the orifice base plate 97 of the liquid discharge head 4, the first and second nozzle arrays 101 and 102 are provided, but the opening area and nozzle shape of each of the discharge ports 106 and 107 are formed to be different from each other. Each of the discharge ports 106 of the first nozzle array 101 is formed to be in the circular hole. Each nozzle of the first nozzle array 101 has the same structure as that of the liquid discharge head 2 described above. Therefore, the description thereof will be omitted. However, in order to make the flow of ink in the bubbling chamber better, the second bubbling chamber 109 is formed on the first bubbling chamber. Also, each discharge port 107 of the second nozzle array 102 is configured radially almost in the form of a star. Each nozzle of the second nozzle array 102, too, is configured to be in the straight form without changing the sectional area of ink flow path across the bubbling chamber and the discharge port.

Also, for the element base plate 96, the supply port 104 is formed to supply ink to the first and second nozzle arrays 101 and 102.

Now, the volume Vd of ink droplet that flies from the discharge port generates the flow of ink in the nozzle. Then, the returning action of meniscus subsequent to the flight of ink droplet is performed by the capillary force generated corresponding to the area of opening of the discharge port. Here, given the opening area of the discharge port as $S_0$; the outer circumference of the opening edge as $L_1$; the surface tension of ink as $\gamma$; and the contact angle of ink with the inner wall as $\theta$, the capillary force p is expressed as follows:

$$p=\gamma \cos \theta \times L_1/S_0.$$

Also, on the assumption that only the volume Vd of ink droplet that has flown generates the meniscus, and it returns after the time t of discharge frequency (refilling time t), the following relations are established:

$$p=B\times(Vd/t)$$

In accordance with the liquid discharge head 4, the ink droplets having different discharge volumes are enabled to fly from a single liquid discharge head 4, because the first and second nozzle arrays 101 and 102, the areas of the first and second heaters 98 and 99, and the opening areas of the discharge ports 106 and 107 are made different from each other.

Also, for the liquid discharge head 4, the material value of ink discharged from the first and second nozzle arrays 101 and 102, such as the surface tension, viscosity, and pH, is the same, and it becomes possible to make the discharge frequency response capabilities of the first and second nozzle arrays 101 and 102 substantially identical by setting the physical quantity, such as the inertance A and the viscosity resistance B, corresponding to the discharge volume of ink droplet discharged from each of the discharge ports 106 and 107.

In other words, in a case where the discharge volume of each ink droplet to be discharged is defined as 4.0 (pl) and 1.0 (pl), respectively, for the first and second nozzle arrays 101 and 102, if the refilling time t is made almost the same for each nozzle arrays 101 and 102 of the liquid discharge head 4, it means that the viscosity resistance B, and the $L_1/S_0$, that is, the ratio between each outer circumferences $L_1$ of the discharge ports 106 and 107, and each opening areas $S_0$ of the discharge ports 106 and 107, are made almost the same.

Now with reference to the accompanying drawings, the description will be made of the method for manufacturing the liquid discharge head 4 structured as described above.

Figure 18A:
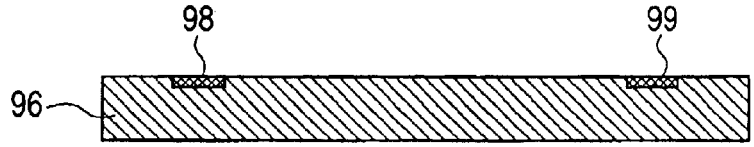
FIGS. 18A, 18B, 18C, 18D, and 18E are first vertical-sectional views that illustrate each step for manufacturing the liquid discharge head in accordance with the fourth invention.
Figure 18B:
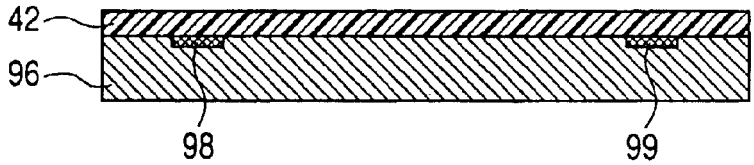
Figure 18C:
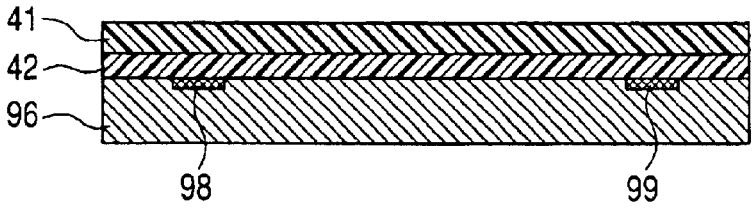
Figure 18D:
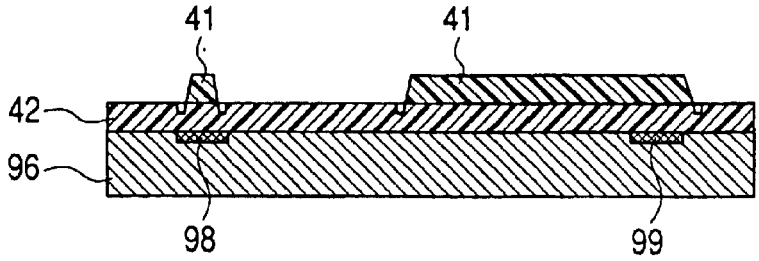
Figure 18E:
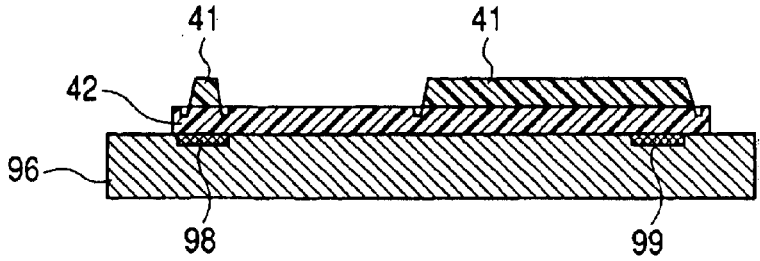
Figure 19A:
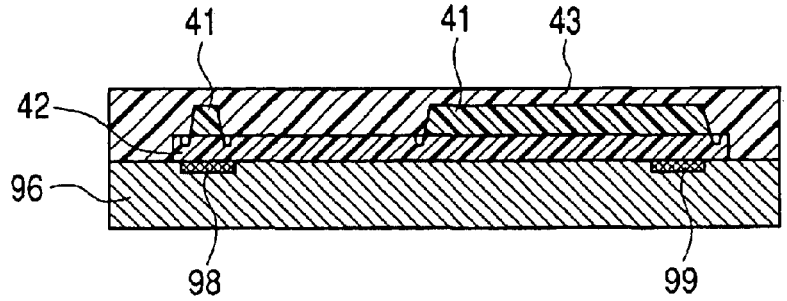
FIGS. 19A, 19B, 19C, and 19D are second vertical-sectional views that illustrate each step for manufacturing the liquid discharge head in accordance with the fourth embodiment of the present invention.
Figure 19B:
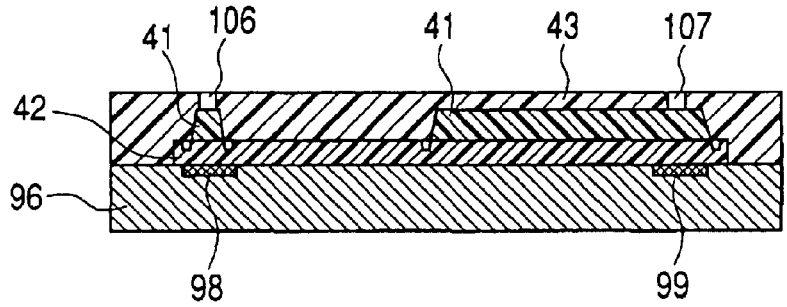
Figure 19C:
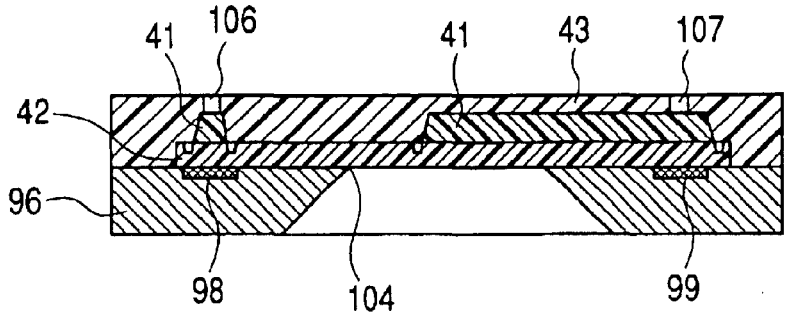
Figure 19D:
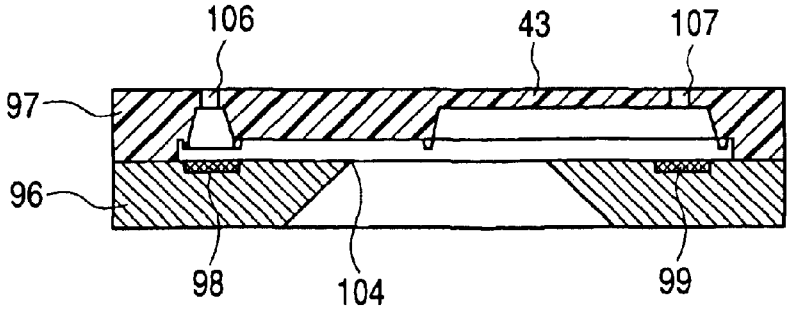

The method for manufacturing the liquid discharge head 4 follows the aforesaid methods for manufacturing the liquid discharge heads 1 and 2, and with the exception of each step of forming nozzle patterns on the upper and lower resin layers 41 and 42 of the element base plate 96, all other steps are the same. As shown in FIG. 18A, FIG. 18B, and FIG. 18C, the upper and lower resin layers 41 and 42 are formed, respectively, in the pattern formation steps for the liquid discharge head 4 in the method of manufacture therefor, and then, as shown in FIG. 18D and FIG. 18E, each of the desired nozzle patterns are formed per the first and second nozzle arrays 101 and 102, respectively, that is, each of the nozzle patterns for the first and second nozzle arrays 101 and 102 are formed to be asymmetrical with respect to the supply port 104, respectively. In other words, with the method for manufacturing the liquid discharge head 4, it is easy to form the liquid discharge head 4 by changing locally the shapes of nozzle patterns for the upper and lower resin layers 41 and 42. The steps after this formation process are the same as those described for the first embodiment in conjunction with FIGS. 19A to 19D. Therefore, the description thereof will be omitted.

In accordance with the liquid discharge head 4 described above, the structure of each nozzle of the first and second nozzle arrays 101 and 102 is arranged to be different from each other to make it possible for each of the nozzle arrays 101 and 102 to discharge ink droplets each having different discharge volume, respectively. In this manner, ink droplets are enabled to fly stably with ease at the optimal discharge frequency for which the higher speed discharge has been attempted.

Also, in accordance with the liquid discharge head 4, it is made possible to suck ink evenly and rapidly when the recovery operation is executed by recovery mechanism with the adjustment to be made for balancing the fluid resistance by the capillary force, while making the formation of simpler structure of recovery mechanism possible. Thus, the reliability of discharge characteristics of the liquid discharge head 4 can be enhanced to provide a recording apparatus capable of performing recording operation more reliably.

In accordance with the liquid discharge head of the present invention as described above, the bubble, which is generated in the first bubbling chamber is developed into the second bubbling chamber, and the discharge volume of ink in the nozzle, which flies as ink droplet through the second bubbling chamber and the discharge port portion, is stabilized, hence making it possible to enhance the discharge efficiency.

Also, in accordance with the liquid discharge head of the present invention, the pressure loss that may be incurred when the bubble, which is generated in the first bubbling chamber, abuts against the inner walls of the second bubbling chamber, is suppressed to enable ink to flow rapidly and efficiently in the bubbling chamber, thus making it possible to enhance the discharge efficiency, as well as to attempt the higher refilling speed.

What is claimed is:

1. A liquid discharge head comprising:

a discharge energy generating element for generating energy for discharging a liquid droplet;

an element base plate provided with said discharge energy generating element on a main surface thereof; and an orifice base plate bonded to the main surface of said element base plate, being provided with a nozzle having a discharge port portion with a discharge port for discharging the liquid droplet, a bubbling chamber for generating a bubble in liquid therein by said discharge energy generating element, and a supply path for supplying liquid to said bubbling chamber, and a supply chamber for supplying liquid to said nozzle, wherein said bubbling chamber is formed by a first bubbling chamber communicated with said supply path with the main surface of said element base plate as the bottom face thereof for generating the bubble in liquid therein by said discharge energy generating element, and also, a second bubbling chamber communicated with said first bubbling chamber, and the central axis of the lower face of said second bubbling chamber and the central axis of the upper face of said second bubbling chamber are in agreement in the direction perpendicular to said base plate, and the sectional area of the upper face with respect to the central axis of said second bubbling chamber is smaller than the sectional area of the lower face with respect to the central axis of said second bubbling chamber, and the sectional area in the direction toward the central axis is continuously changed from the lower face to the upper face of said second bubbling chamber, and on the circumferential portion of the upper face of said first bubbling chamber in parallel with the main surface of said element base plate, and in contact with the opening communicated with said second bubbling chamber, an extrusion is formed continuously to surround said opening in the direction toward the main face of said element base plate.

2. A liquid discharge head according to claim 1, wherein the sectional area of the sidewall face of said second bubbling chamber is continuously changed in the direction toward the central axis from the lower face to the upper face of said second bubbling chamber at an inclination of 10 to 45° to the plane orthogonal to the main surface of said element base plate.

3. A liquid discharge head according to claim 1, wherein said first bubbling chamber is surrounded by a nozzle wall in three directions for partitioning a plurality of said nozzles arranged in parallel condition into each individual nozzle, and a wall face of said discharge port portion is in parallel with the plane orthogonal to the main surface of said element base plate.

4. A liquid discharge head according to claim 1, wherein said first bubbling chamber is surrounded by a nozzle wall in three directions for partitioning a plurality of said nozzles arranged in parallel condition into each individual nozzle, and a wall face of said discharge port portion is provided with a taper of 10° or less to the plane orthogonal to the main surface of said element base plate.

5. A liquid discharge head according to claim 1, wherein the upper face of said supply path on the said supply chamber side in parallel with the main surface of said element base plate is higher than the upper face of said supply path continued on one and the same plane with the upper surface of said first bubbling chamber, and connected with a difference in level, and the largest height of said supply path from the surface of said element base plate is lower than the height from the surface of said element base plate to the upper face of said second bubbling chamber.

6. A liquid discharge head according to claim 1, wherein at least in a part of said supply path, the width of said supply path on the plane orthogonal to the flow direction of liquid is changed in the thickness direction of said orifice base plate.

7. A liquid discharge head according to claim 1, wherein the sectional area of said nozzle from said discharge port to said supply chamber is further structured to be changed by plural differences in level.

8. A liquid discharge head according to claim 1, wherein said nozzle is formed so as to orthogonalize the discharge direction of flying droplets from said discharge port and the flowing direction of liquid flowing in said supply path.

9. A liquid discharge head according to claim 1, wherein said nozzle is formed so as to make the total sum of the volumes of said first bubbling chamber, the second bubbling chamber, and the discharge port portion smaller than the volume of said supply path.

10. A liquid discharge head according to claim 1, wherein the bubble generated by said discharge energy generating element is communicated with the air outside at the time of discharging the liquid droplet.

11. A liquid discharge head according to claim 1, wherein said orifice base plate is provided with plural nozzles corresponding to plural discharge energy generating elements, respectively, and said plural nozzles are divided into a first nozzle array having the longitudinal direction of each nozzle arranged in parallel, and a second nozzle array having the longitudinal direction of each nozzle arranged in parallel in the position facing said first nozzle array with said supply chamber between them, and the center line of each of said nozzles in said second nozzle array is arranged so as to be displaced by ½ pitch between each of adjacent nozzles with respect to the center line in the longitudinal direction of each of said nozzles of said first nozzle array.

* * * * *